US007997561B2

(12) United States Patent
Goldmann et al.

(10) Patent No.: US 7,997,561 B2
(45) Date of Patent: Aug. 16, 2011

(54) DEVICE FOR APPLYING COOLING MIST TO INDIVIDUALS WITHOUT WATER ACCUMULATION

(75) Inventors: Richard Goldmann, Poughkeepsie, NY (US); Russ Weinzimmer, Milford, NH (US); Douglas P. Burum, Acton, MA (US)

(73) Assignee: Richard Goldmann, Poughkeepsie, NY (US)

( * ) Notice: Subject to any disclaimer, the term of this patent is extended or adjusted under 35 U.S.C. 154(b) by 958 days.

(21) Appl. No.: 11/981,862

(22) Filed: Oct. 31, 2007

(65) Prior Publication Data

US 2009/0108087 A1 Apr. 30, 2009

(51) Int. Cl.
*B01F 3/04* (2006.01)

(52) U.S. Cl. ..... 261/26; 261/115; 261/DIG. 43; 239/11

(58) Field of Classification Search ..... 261/26, 261/27, 28, 84, 115, 116, DIG. 3, DIG. 43; 239/11
See application file for complete search history.

(56) References Cited

U.S. PATENT DOCUMENTS

| | | | | |
|---|---|---|---|---|
| 3,231,269 | A | 1/1966 | Dalrymple | |
| 3,595,571 | A | 7/1971 | Spinnett | |
| 3,625,434 | A | 12/1971 | Kitover | |
| 4,099,522 | A | 7/1978 | Alenares | |
| 4,206,877 | A | 6/1980 | Hoza | |
| 4,643,355 | A * | 2/1987 | Sanders et al. | 239/2.1 |
| 4,765,542 | A | 8/1988 | Carlson | |
| 5,193,354 | A * | 3/1993 | Kleinberger et al. | 62/247 |
| 5,350,117 | A * | 9/1994 | Kleinberger et al. | 239/428.5 |
| 5,497,633 | A * | 3/1996 | Jones et al. | 62/314 |
| 5,762,661 | A * | 6/1998 | Kleinberger et al. | 96/253 |
| 5,940,880 | A | 8/1999 | Phillips | |
| 6,155,495 | A | 12/2000 | Jones | |
| 6,182,463 | B1 * | 2/2001 | Strussion et al. | 62/314 |
| 6,196,474 | B1 | 3/2001 | Hillerson | |
| 6,216,961 | B1 * | 4/2001 | Utter et al. | 239/153 |
| 6,325,362 | B1 * | 12/2001 | Massey et al. | 261/127 |
| 6,471,194 | B2 * | 10/2002 | Keeney | 261/30 |
| 6,543,247 | B2 * | 4/2003 | Strauss | 62/259.3 |
| 6,592,049 | B1 | 7/2003 | Van Wolput | |
| 7,055,763 | B2 | 6/2006 | Torigoe | |
| 7,137,269 | B1 | 11/2006 | Maranville | |
| 7,150,162 | B1 | 12/2006 | Brunner | |
| 7,175,571 | B1 | 2/2007 | Rodgers | |
| 7,422,163 | B1 * | 9/2008 | DeVorss | 239/289 |
| 2003/0188477 | A1 * | 10/2003 | Pasternak et al. | 47/17 |
| 2005/0172987 | A1 | 8/2005 | Byrnes | |
| 2007/0089448 | A1 | 4/2007 | Critchfield | |

FOREIGN PATENT DOCUMENTS

| | | |
|---|---|---|
| JP | 26280502 A2 | 10/2006 |

* cited by examiner

*Primary Examiner* — Charles Bushey
(74) *Attorney, Agent, or Firm* — Russ Weinzimmer; Russ Weinzimmer & Associates PC

(57) ABSTRACT

An apparatus and method of use are disclosed for cooling one or more exercising or resting individuals with a water mist while automatically preventing the undesirable accumulation of excess water. In some embodiments, a sensor detects accumulated water on or near an individual, while other embodiments use measured climate parameters to predict water accumulation. The apparatus can be free standing, fixed to the walls or ceiling, or attached to an object on which an individual is resting or exercising. In some preferred embodiments, the apparatus is controlled according to the passing of time and/or one or more measured physiological parameters measured by sensors directed toward or attached to an individual, or embedded in an object on which an individual is resting or exercising. In some embodiments dry air is also applied either simultaneously or alternately with the mist to enhance cooling and further discourage water accumulation.

30 Claims, 27 Drawing Sheets

DEVICE FOR APPLYING COOLING MIST TO INDIVIDUALS WITHOUT WATER ACCUMULATION

FIELD OF THE INVENTION

The invention generally relates to devices and methods for cooling individuals, and more specifically to evaporative cooling of individuals.

BACKGROUND OF THE INVENTION

There are many circumstances wherein individuals can become overheated. Vigorous exercise is a clear example, as well as leisure activities under conditions of high temperatures and/or intense sunlight. Active and effective cooling of individuals under these circumstances can protect their health and significantly increase their comfort and enjoyment.

Evaporative cooling is well known as a highly effective means for cooling individuals. Indeed, it is the mechanism by which the body cools itself through perspiration. The discomfort and potential dehydration of cooling by perspiration can be avoided through the application of a mist of water to an individual, which cools the body in essentially the same manner as perspiration, and can be even more effective than perspiration since the mist impacts the skin at a temperature significantly below body temperature, and hence absorbs more heat than an equivalent quantity of perspiration.

Means for generating and applying a water mist to one or more individuals are well known, and yet not widely used. In part, this is because there is a tendency for mist to accumulate to an extent that causes discomfort due to excessive dampness of the skin, and wetting of the clothing.

SUMMARY OF THE INVENTION

An apparatus and method of use thereof are disclosed, wherein the apparatus combines a device for applying water droplets to one or more individuals with a means for automatically limiting the application of water droplets so as to prevent excessive water accumulation, thereby cooling the one or more individuals without undesirable wetness.

In preferred embodiments, the water droplets are in the form of a mist, a spray, or a shower. Some preferred embodiments utilize one or more sensors placed on or near the skin or clothing of an individual to directly measure the accumulation of water. Other preferred embodiments measure climate conditions such as the air temperature, humidity, and velocity of the ambient air, and estimate the potential for water accumulation.

In some preferred embodiments, the water droplet emission device is attached to an object on which an individual is resting or exercising. In other preferred embodiments, the water droplet emission device is free standing, is built into a wall or ceiling, or is part of the climate control system for an entire room. Depending on the preferred embodiment, the device for applying water droplets controls one or more of the duration of emitting of water droplets, frequency of emitting of water droplets, numerical density of emitted water droplets, size of emitted water droplets, temperature of emitted water droplets, direction of travel of emitted water droplets, speed of travel of emitted water droplets, and rate of divergence of emitted water droplets.

In some preferred embodiments, the apparatus is manually controlled, while in other preferred embodiments the apparatus is automatically controlled. In some of the latter preferred embodiments, the apparatus is controlled according to the passing of time and/or according to one or more measured physiological parameters such as the skin temperature, core body temperature, heart rate, and rate of perspiration. Physiological parameters can be measured by sensors attached to an individual or sensors embedded in an object or device on which an individual is resting or exercising. In other preferred embodiments the apparatus is automatically controlled at least partly according to the amount of activity and/or the amount of energy exerted on an exercise machine.

In preferred embodiments, the water droplets are carried by a stream of air, and in some of these preferred embodiments the speed and direction of the stream of air is controlled by the apparatus. In further preferred embodiments, the humidity of the air surrounding the one or more individuals is reduced, so as to increase the cooling efficiency of the water droplets and reduce the tendency of water to accumulate. In some of these preferred embodiments, water droplets are injected either continuously or alternately into a stream of dry air. In other preferred embodiments, a separate stream of dry air is applied to the one or more individuals, either continuously or alternating with droplet application.

The method of use of the invention includes providing an apparatus as described above, applying water droplets, determining the degree of water accumulation either by sensing or estimating, and limiting the application of water droplets when it is determined that too much water is accumulating. Preferred embodiments of the method include the application of dry air so as to increase the efficiency of cooling and reduce the tendency of water to accumulate.

BRIEF DESCRIPTION OF THE DRAWINGS

in FIG. 6A the water droplet accumulation limiter stops the application of mist and waits until the accumulated water evaporates naturally;

in FIG. 6B the water droplet accumulation limiter stops the application of mist and initiates either the application of dry air or some other action that promotes water evaporation; and in FIG. 6C the water droplet accumulation limiter continues to apply mist but reduces the duration and/or intensity of the mist;

in FIG. 6D the water droplet accumulation limiter stops the application of mist and waits for the accumulated water to evaporate naturally;

in FIG. 6E the water droplet accumulation limiter stops the application of mist, and initiates the application of dry air or some other action that promotes water evaporation; and in FIG. 6F the water droplet accumulation limiter continues to apply mist but reduces the duration and/or intensity of the mist;

Figure 6A:
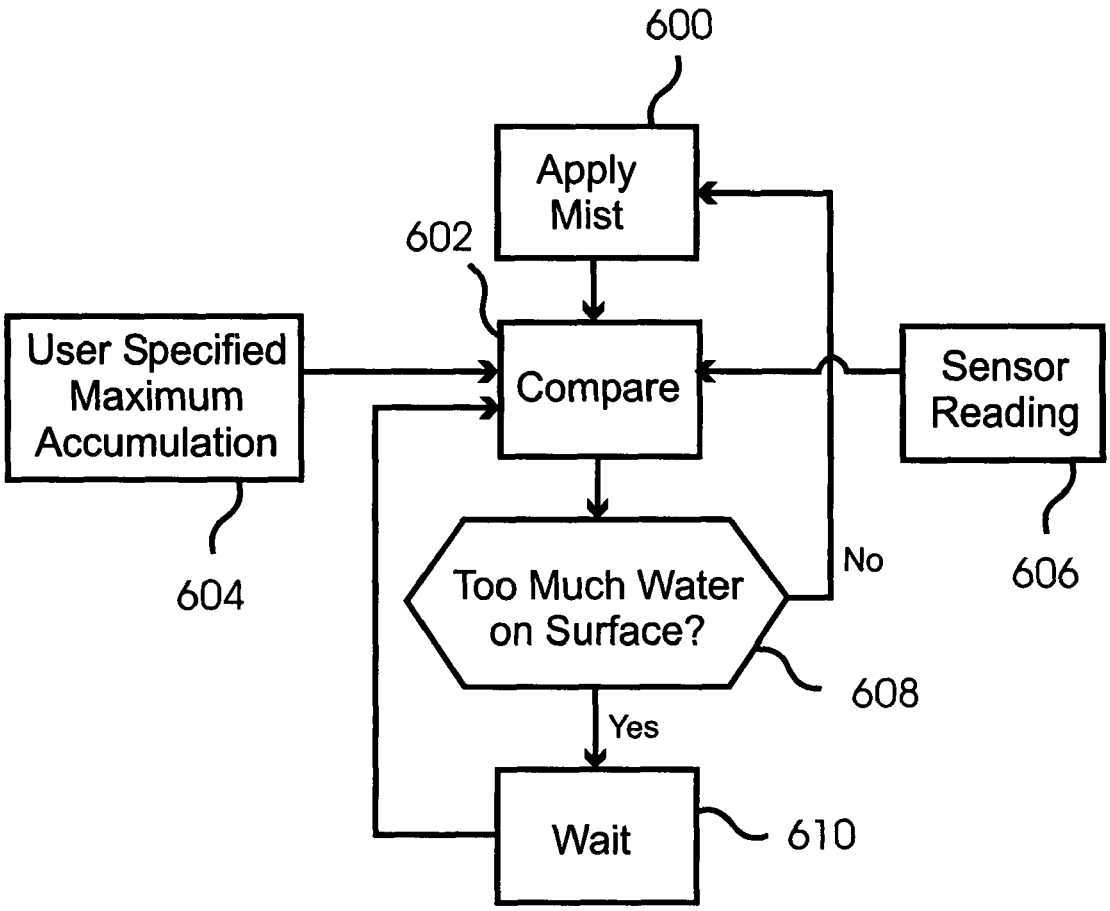
FIG. 6A through FIG. 6C are logic diagrams that depict strategies used by water droplet accumulation limiters when sensors detect water accumulation.
Figure 6B:
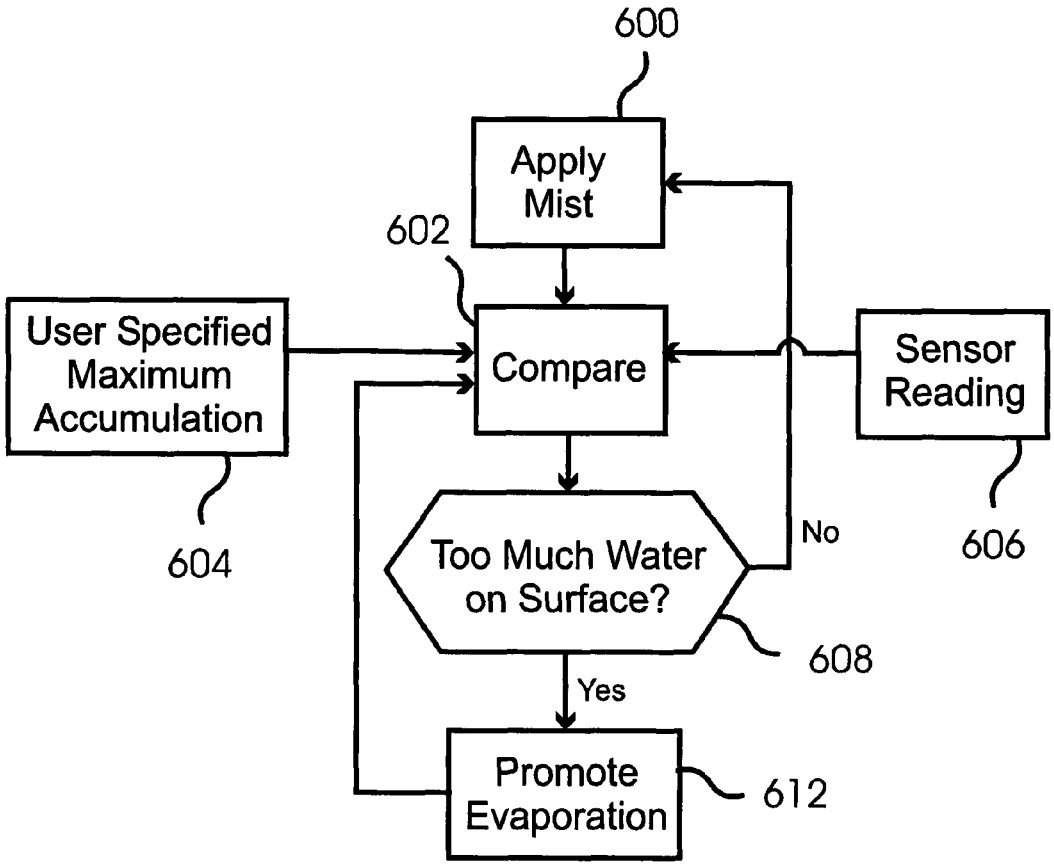
Figure 6C:
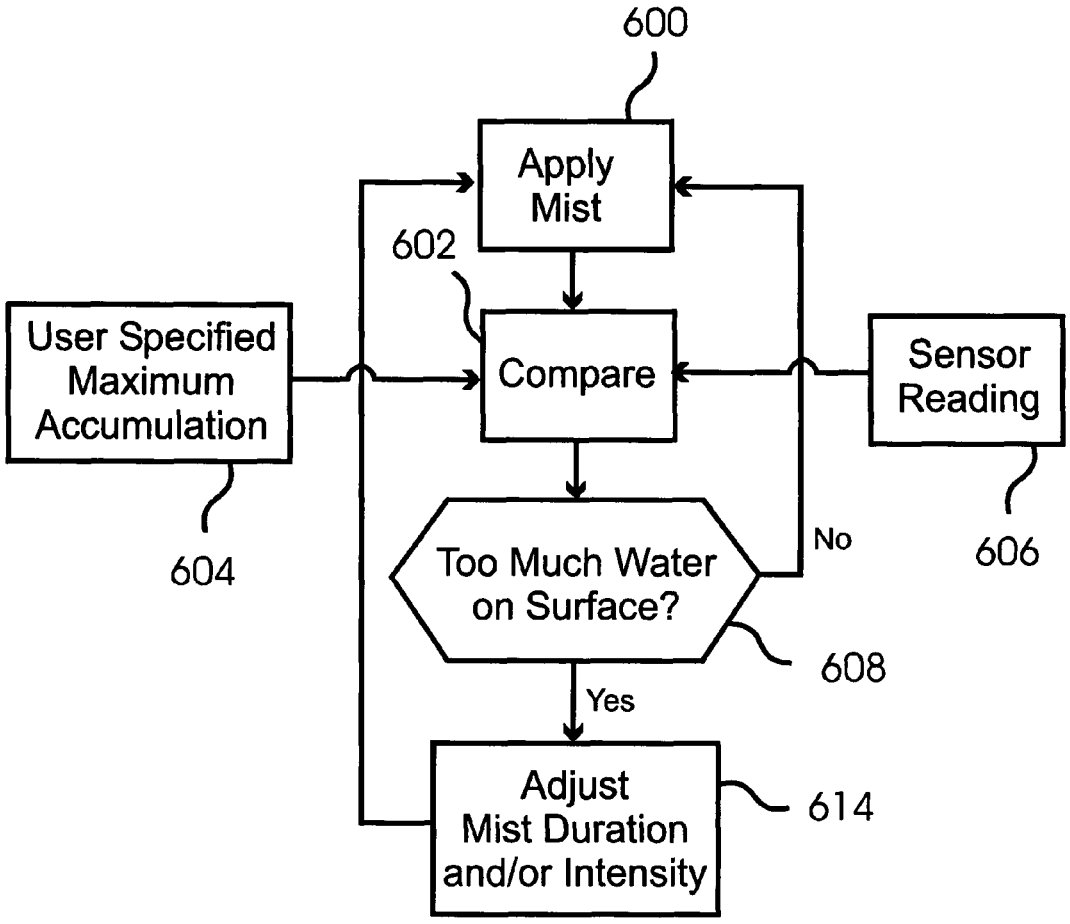
Figure 6D:
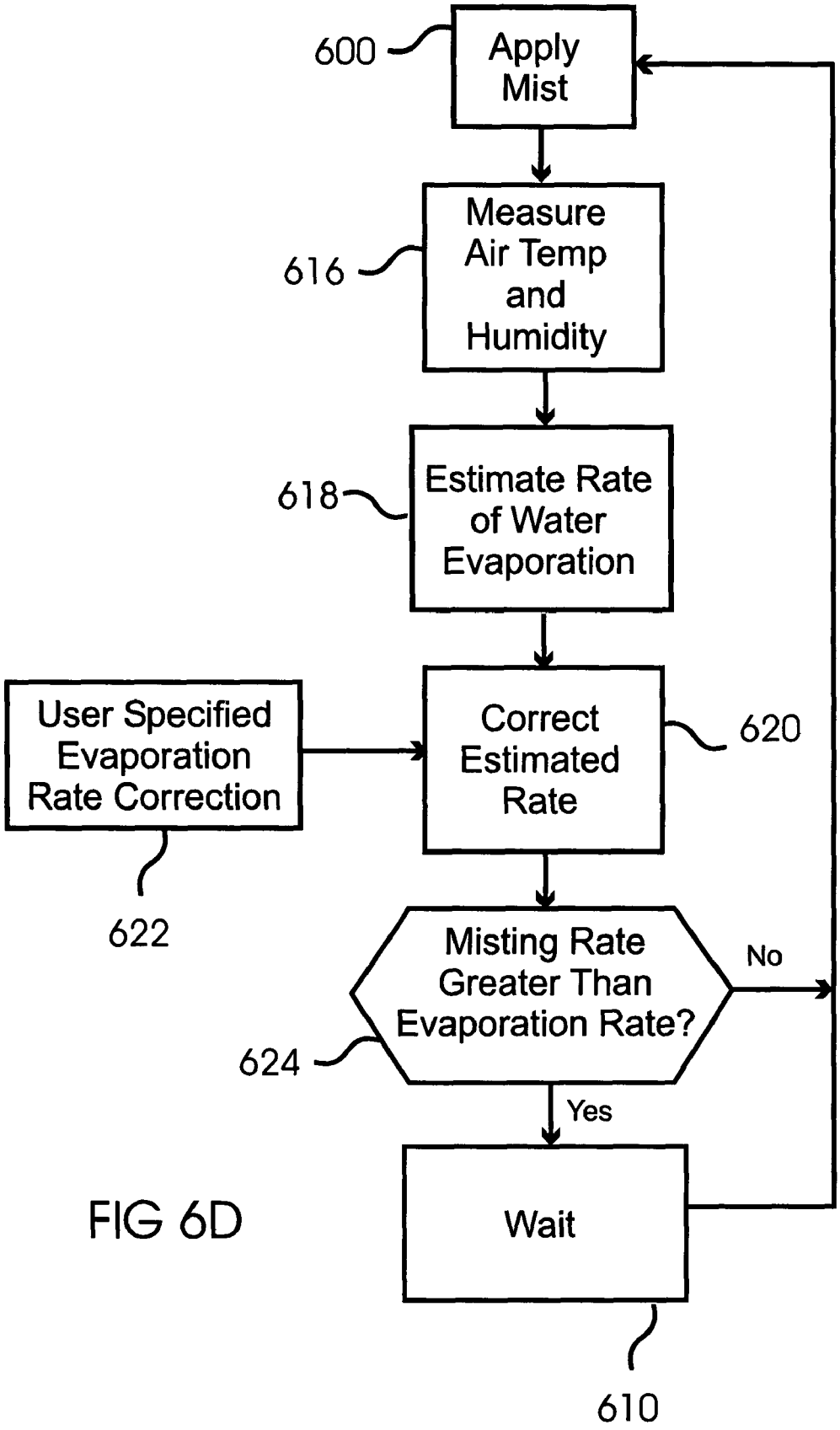
FIG. 6D through FIG. 6F are logic diagrams depicting strategies used by water droplet accumulation limiters when water accumulation is predicted based on measured climate parameters.
Figure 6E:
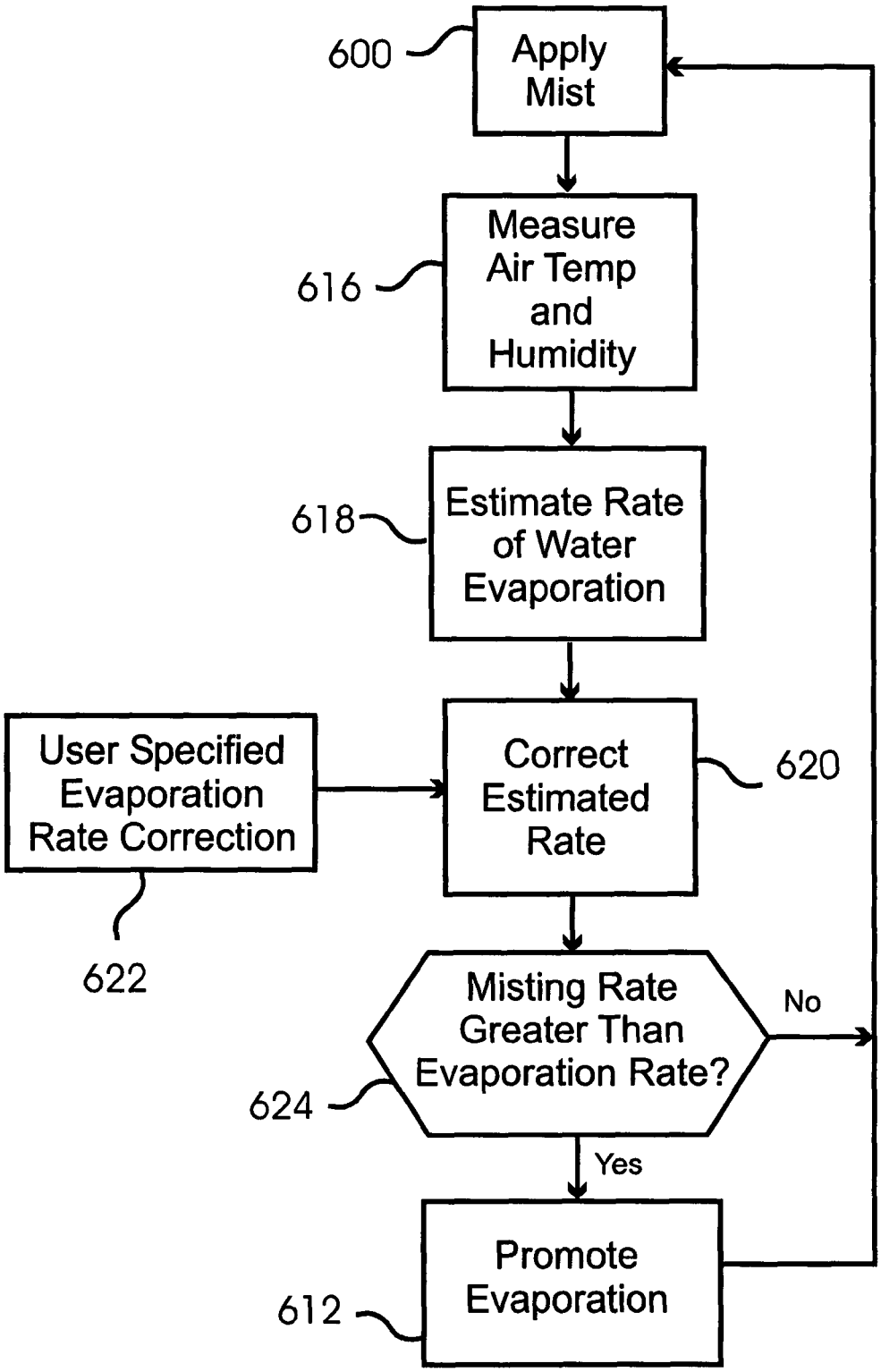
Figure 6F:
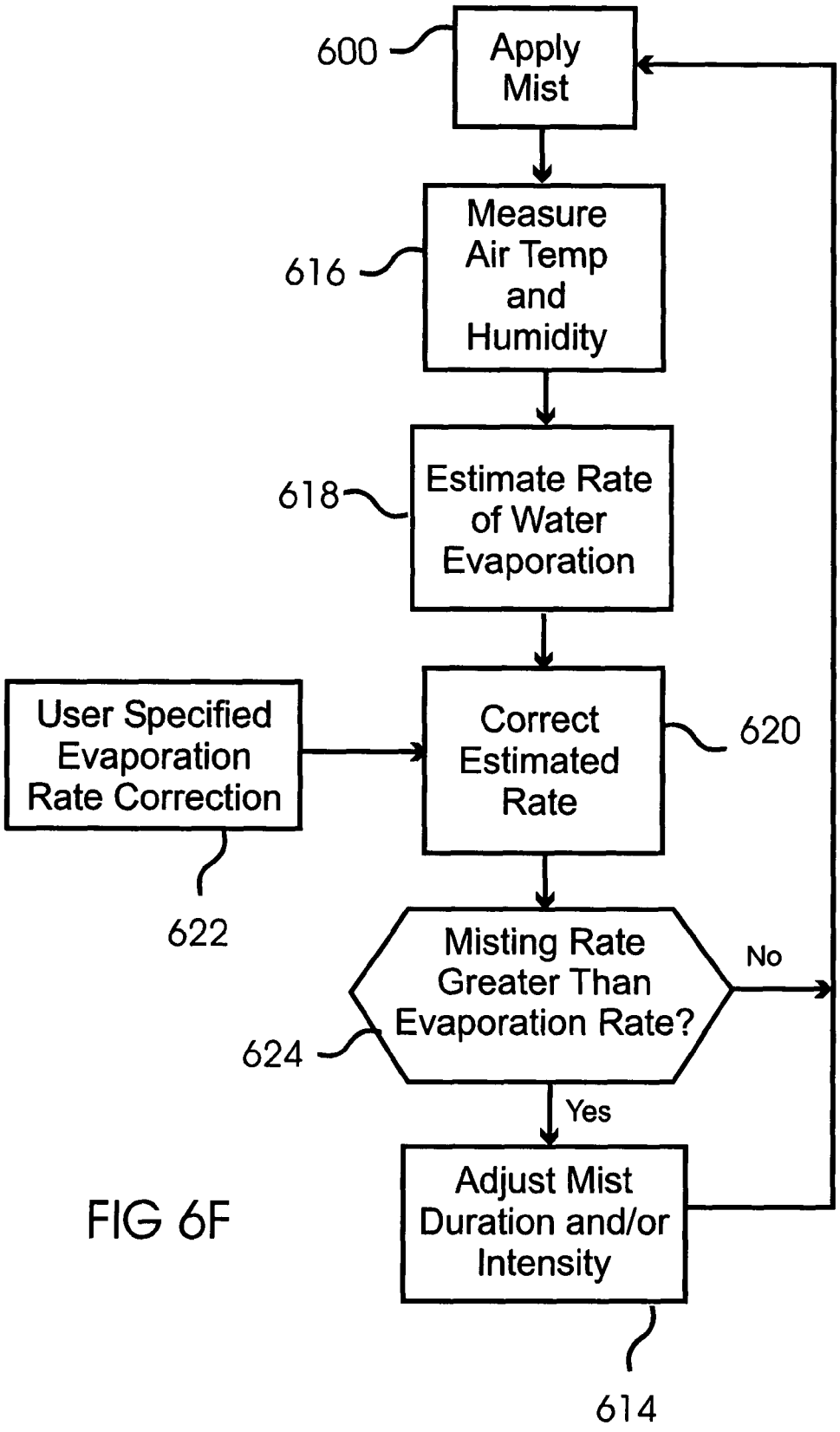
Figure 6G:
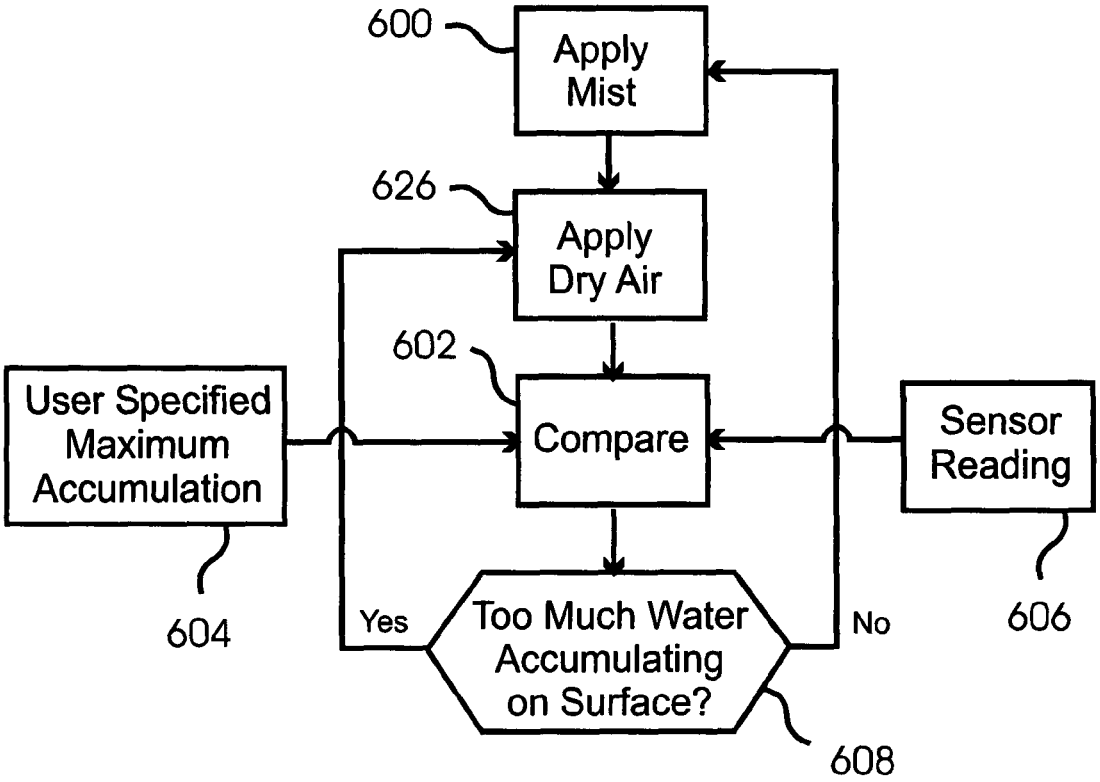
Figure 6H:
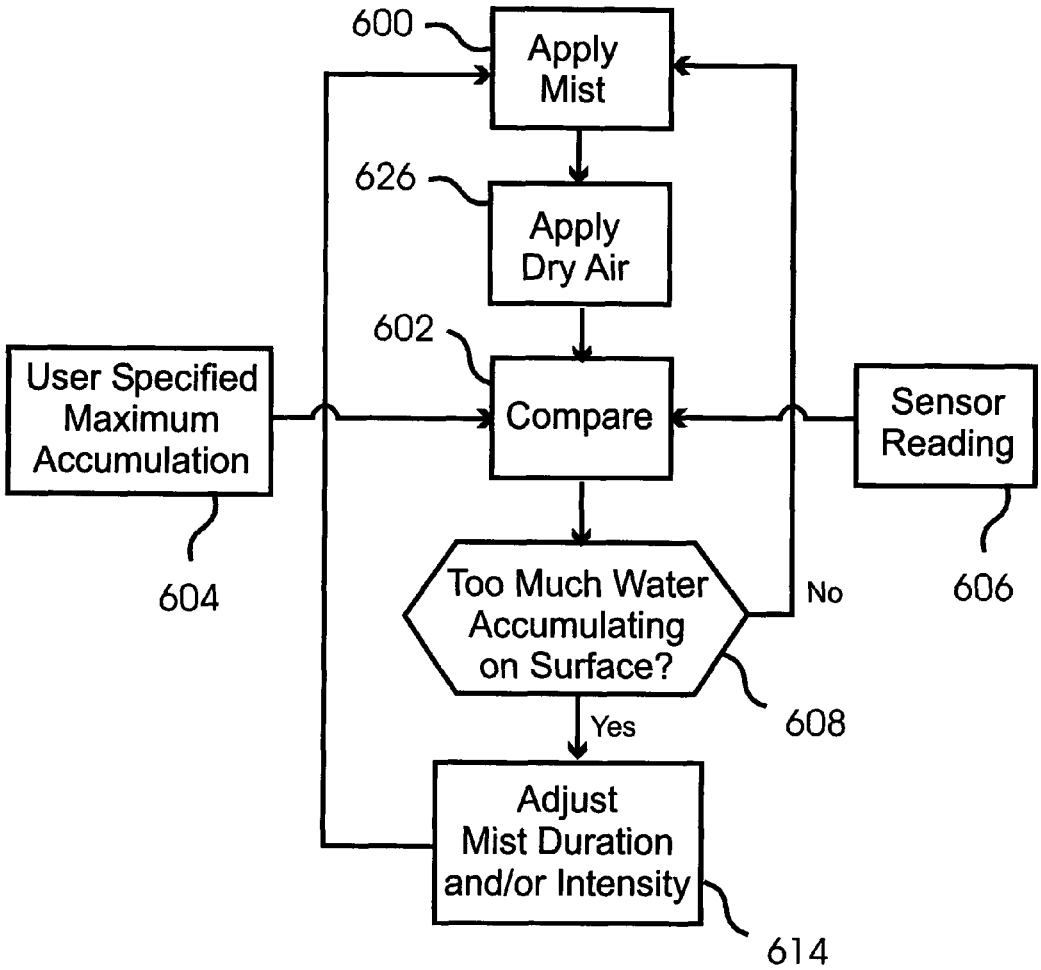
Figure 7A:
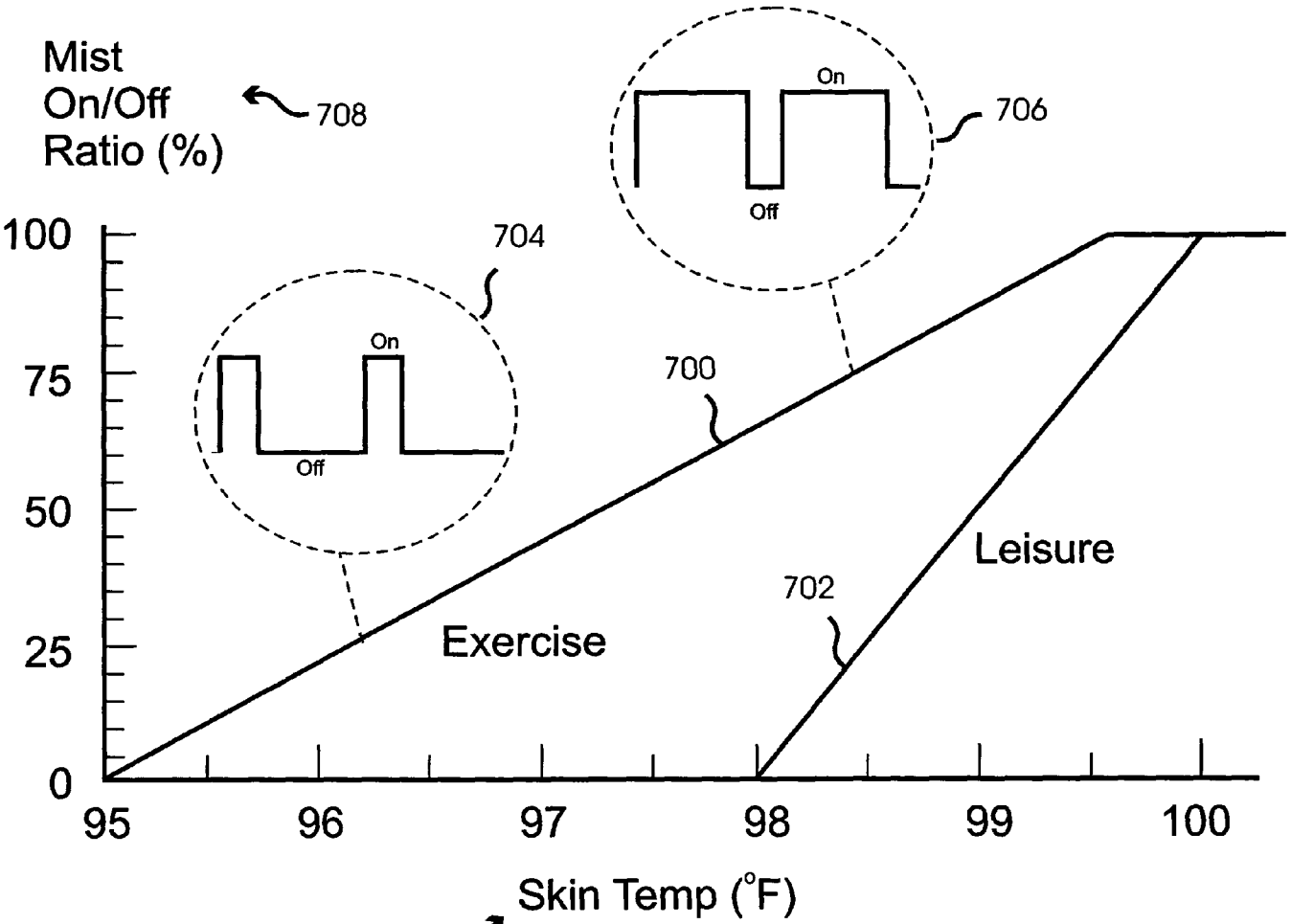
Figure 7B:
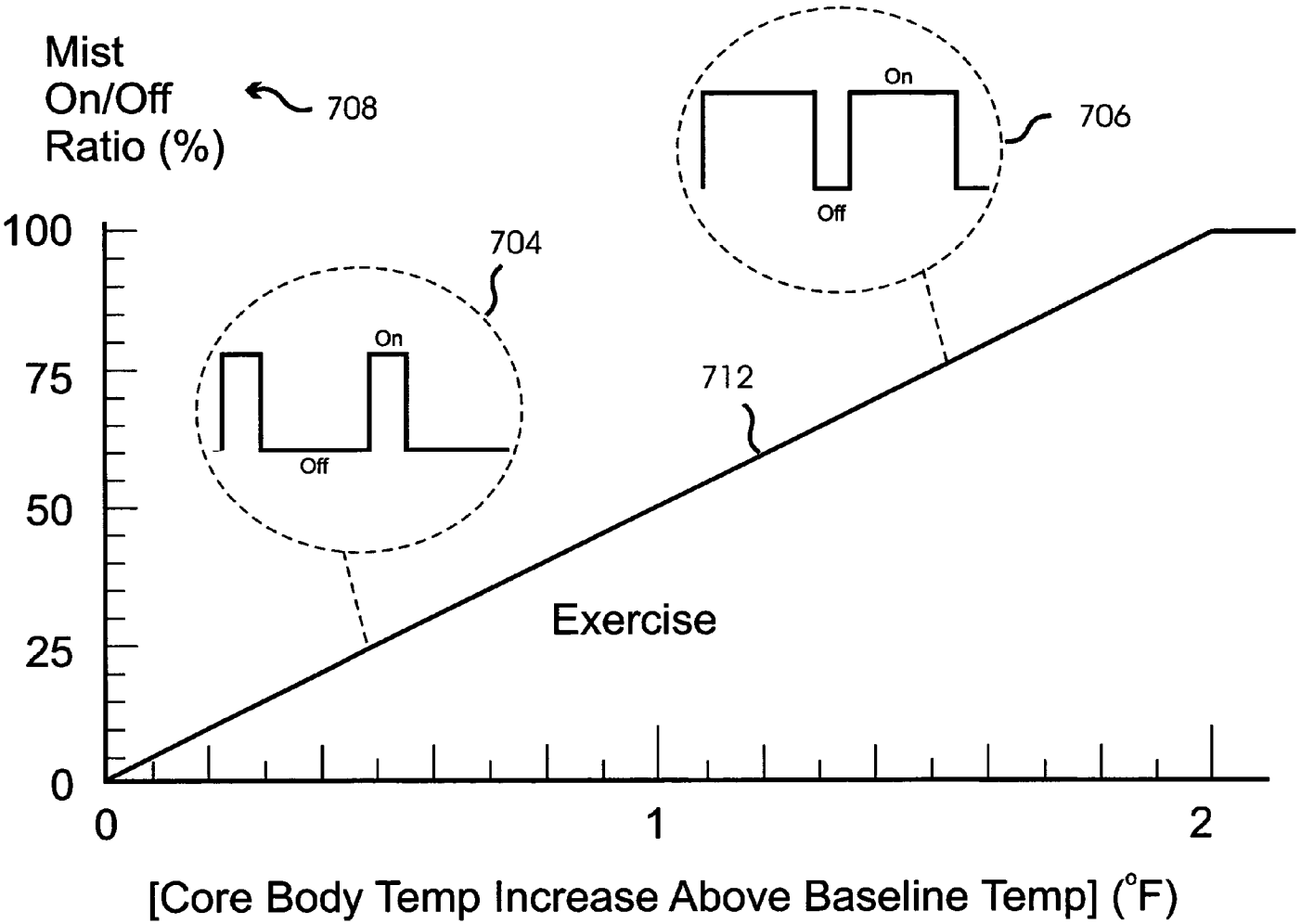
Figure 7C:
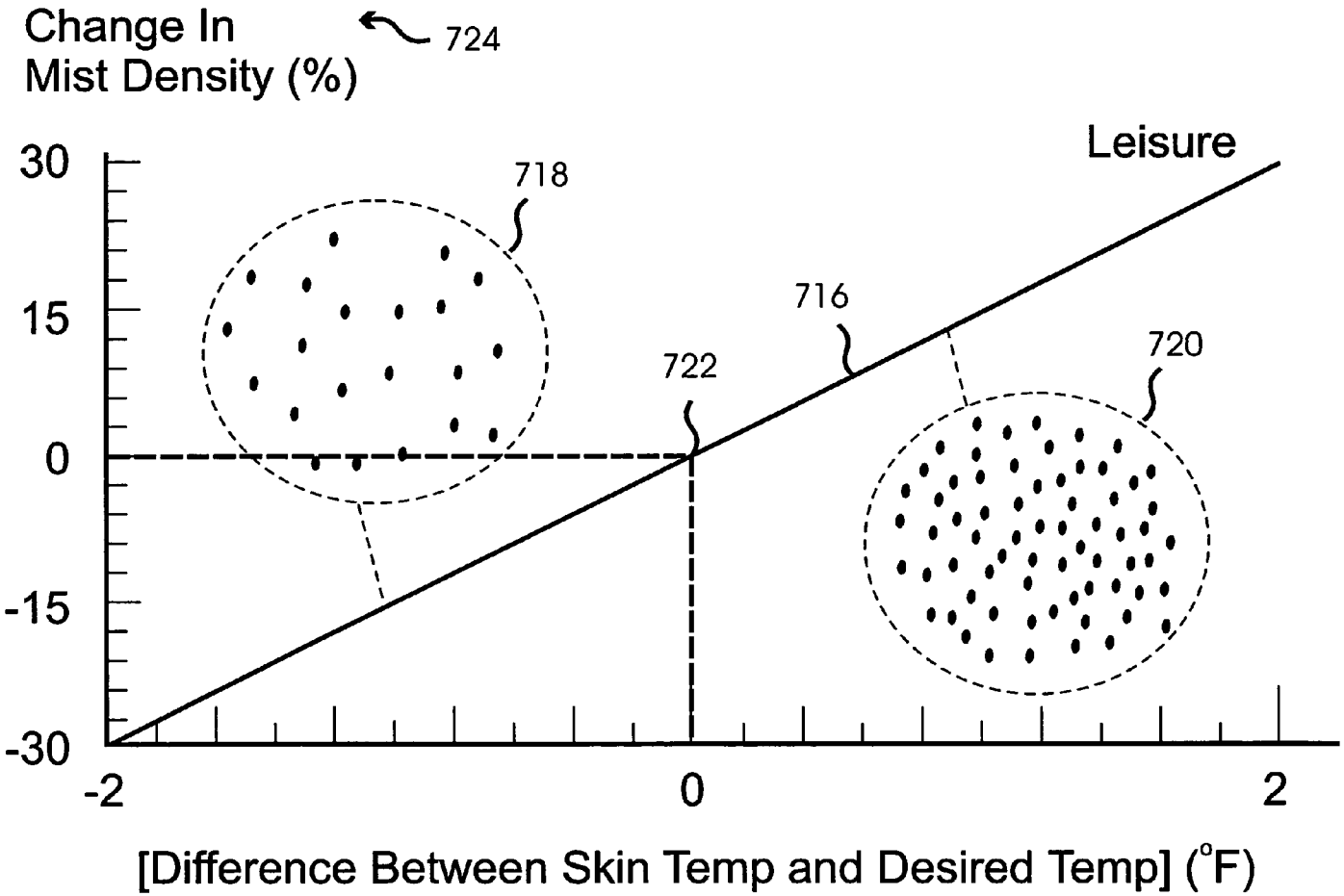
Figure 7D:
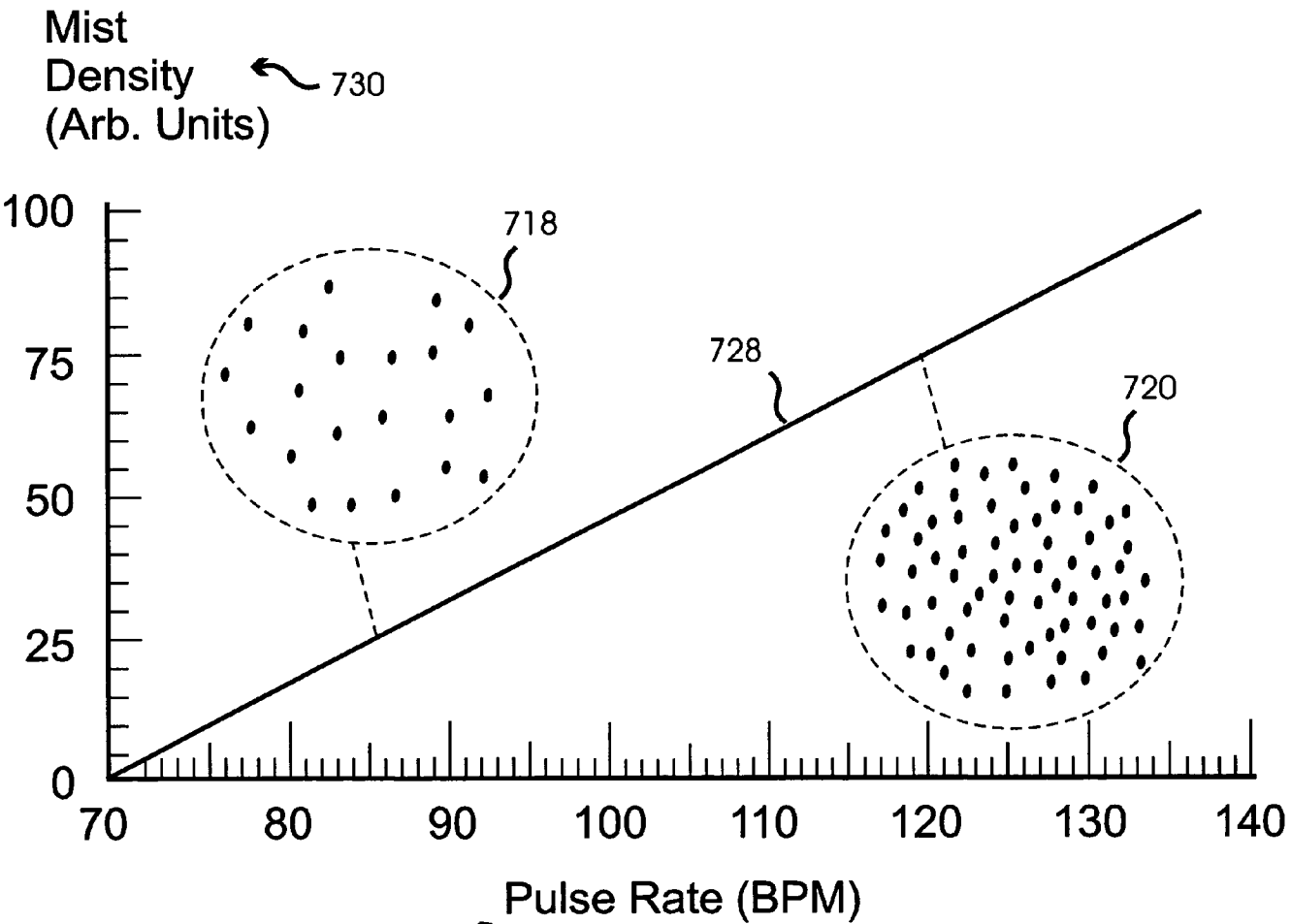
Figure 7E:
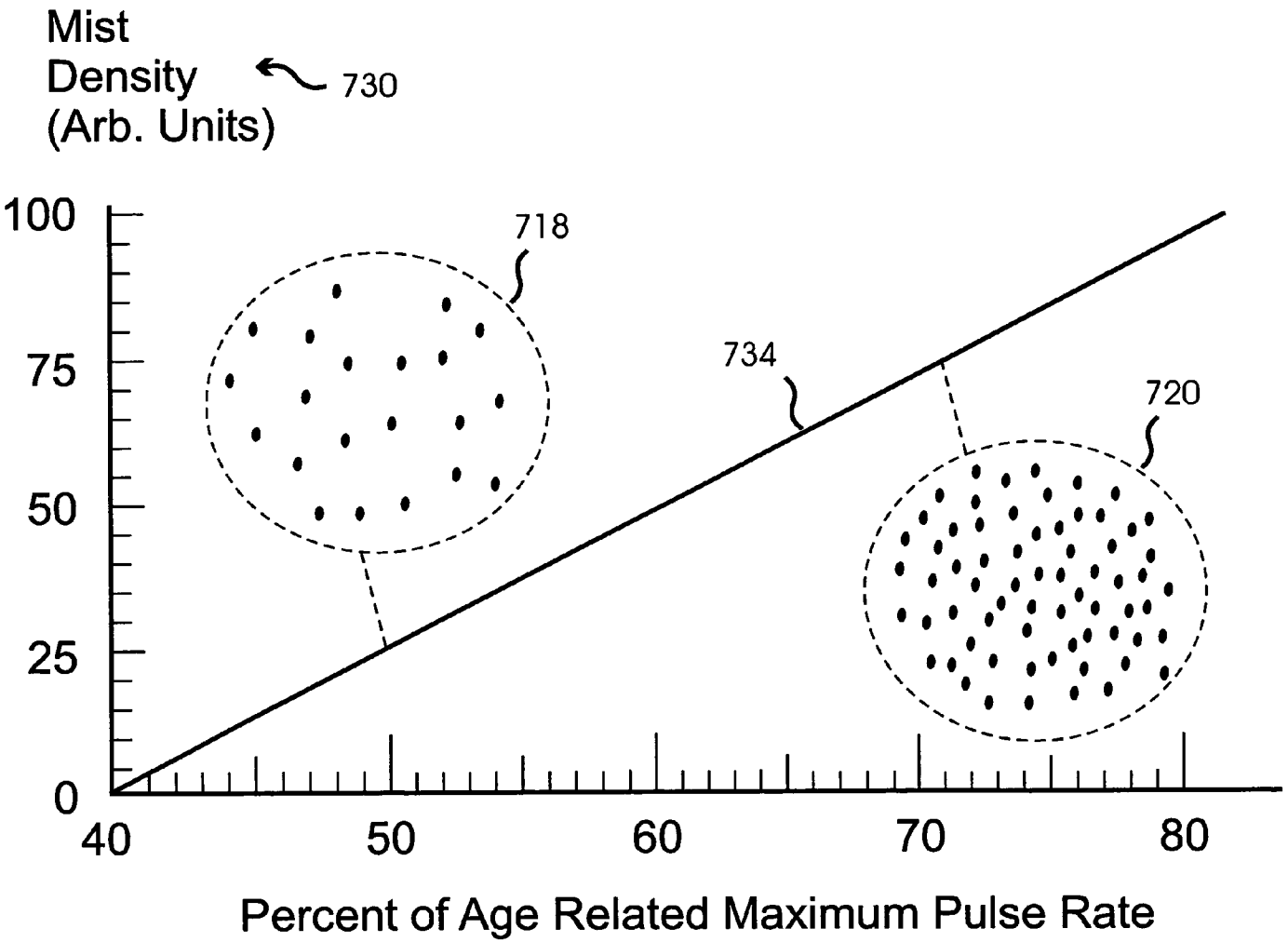
Figure 8:
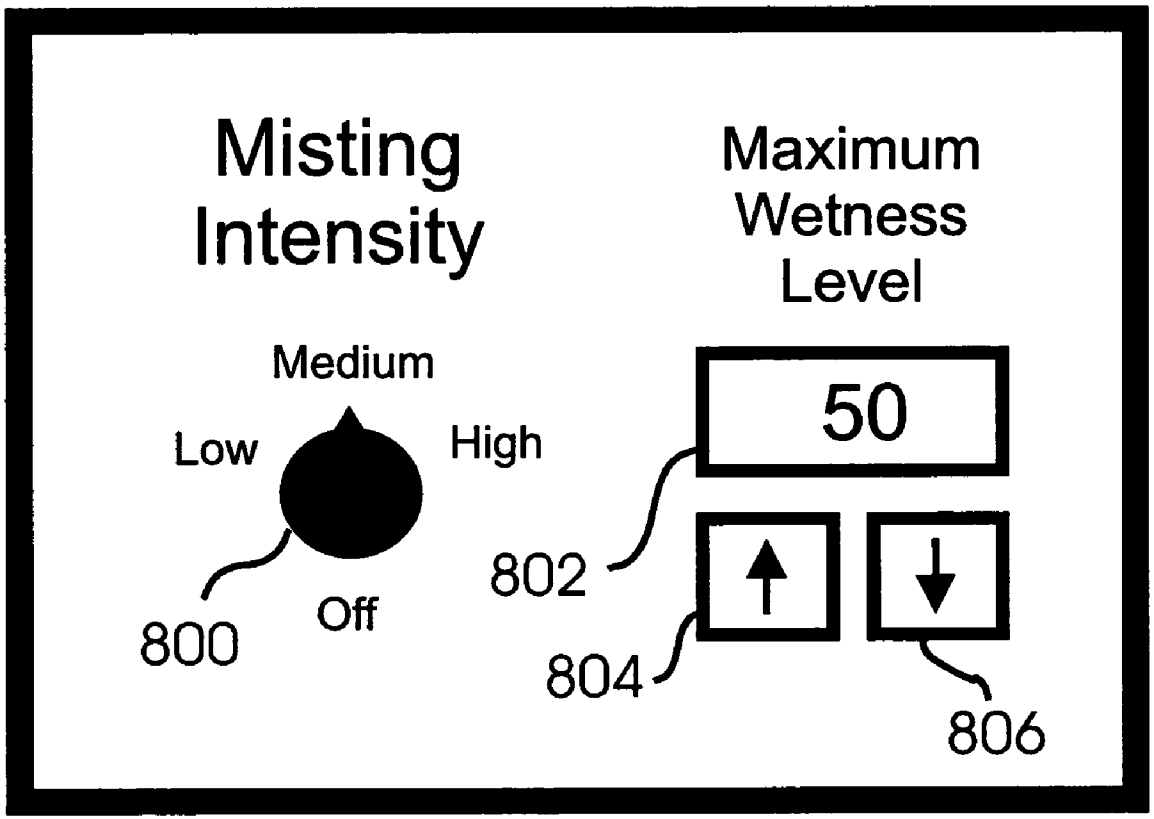
Figure 9:
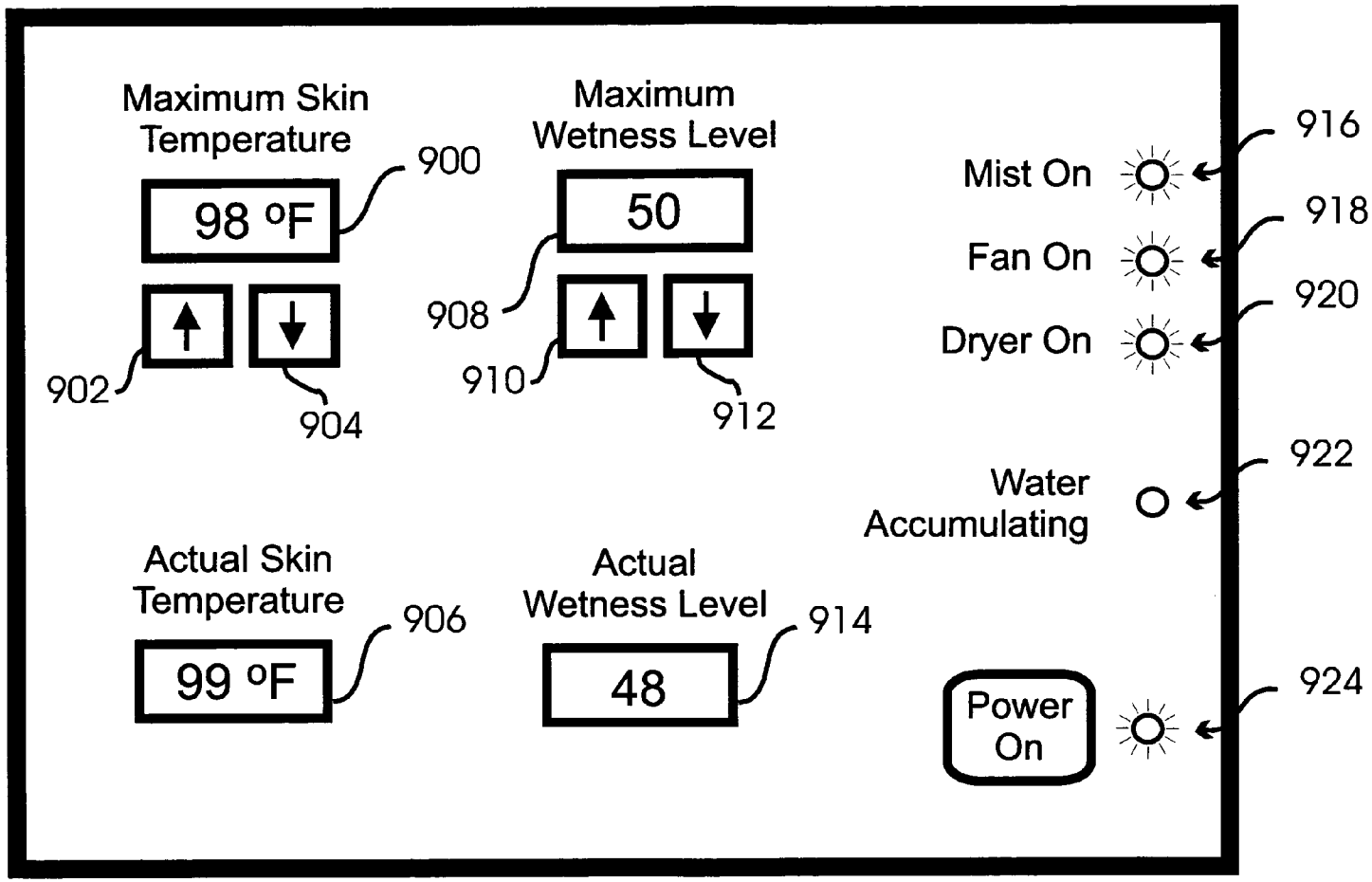
Figure 10A:
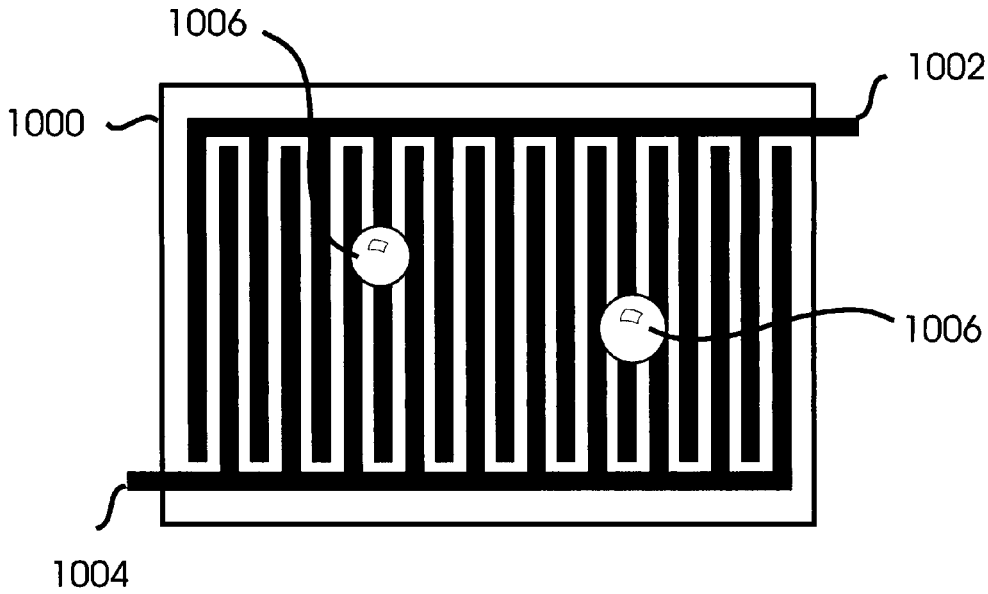
Figure 10B:
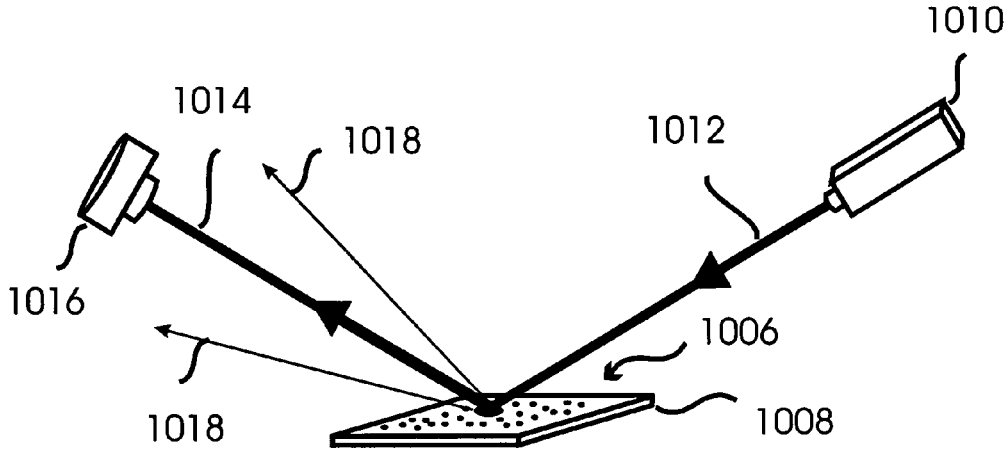

the logic diagrams of FIG. 6G and FIG. 6H refer to preferred embodiments that include dry air application devices, depicting strategies used by water droplet accumulation limiters when sensors detect water accumulation;

in FIG. 6G the apparatus stops applying mist but continues to apply dry air; and in FIG. 6H the apparatus adjusts the duration and/or the intensity of the mist and continues to apply dry air;

FIG. 7A is a graphical presentation of mist control strategies for exercising and resting individuals in preferred embodiments wherein the droplets are applied intermittently and wherein sensors are used to measure the skin temperatures of the individuals;

FIG. 7B is a graphical presentation of a mist control strategy for an exercising individual in a preferred embodiment wherein the water droplets are applied intermittently and a sensor is used to measure the deviation of the core body temperature of the individual away from a baseline temperature;

FIG. 7C is a graphical presentation of a mist control strategy for a resting individual in a preferred embodiment wherein the intensity of water droplets is varied until the cooling effect of the water droplets is sufficient to maintain a desired skin temperature;

FIG. 7D is a graphical presentation of a mist control strategy wherein the density of the mist is varied according to a measured pulse rate of an exercising individual;

FIG. 7E is a graphical presentation of a mist control strategy wherein the density of the mist is varied according to the ratio of the measured pulse rate of an exercising individual to the age related maximum pulse rate for the individual;

FIG. 8 is a front drawing of a control panel for a preferred embodiment wherein the user manually adjusts the desired level of misting intensity and the maximum wetness level (in arbitrary units);

FIG. 9 is a front drawing of a control panel for a preferred embodiment wherein the apparatus is automatically controlled according to the measured skin temperature and wetness of an individual as compared to user specified maximums, and wherein the apparatus controls the air flow and humidity of the air near the individual in addition to the application of mist;

FIG. 10A is an illustration of a conductivity-based wetness sensor;

FIG. 10B is an illustration of a reflectivity-based wetness sensor; and

Figure 10C:
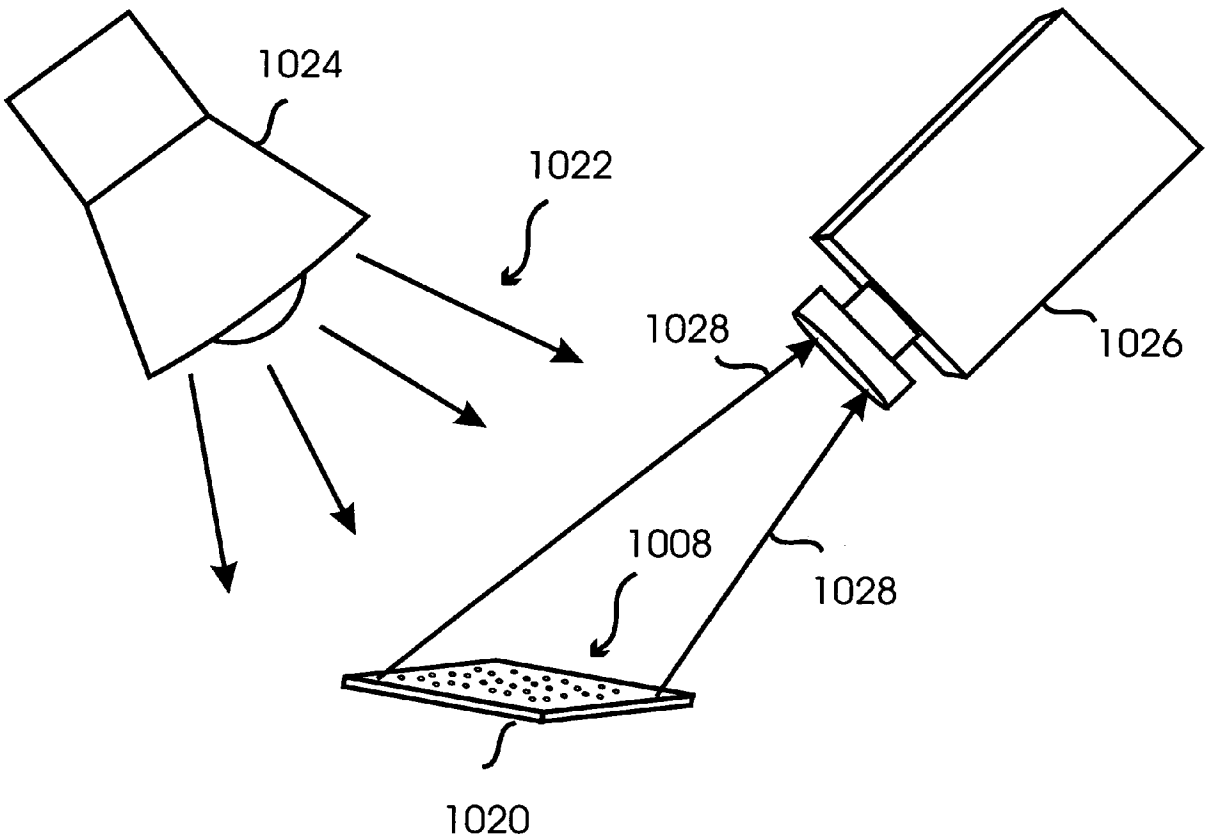

FIG. 10C is an illustration of a machine vision based wetness sensor.

DETAILED DESCRIPTION OF PREFERRED EMBODIMENTS

Figure 1A:
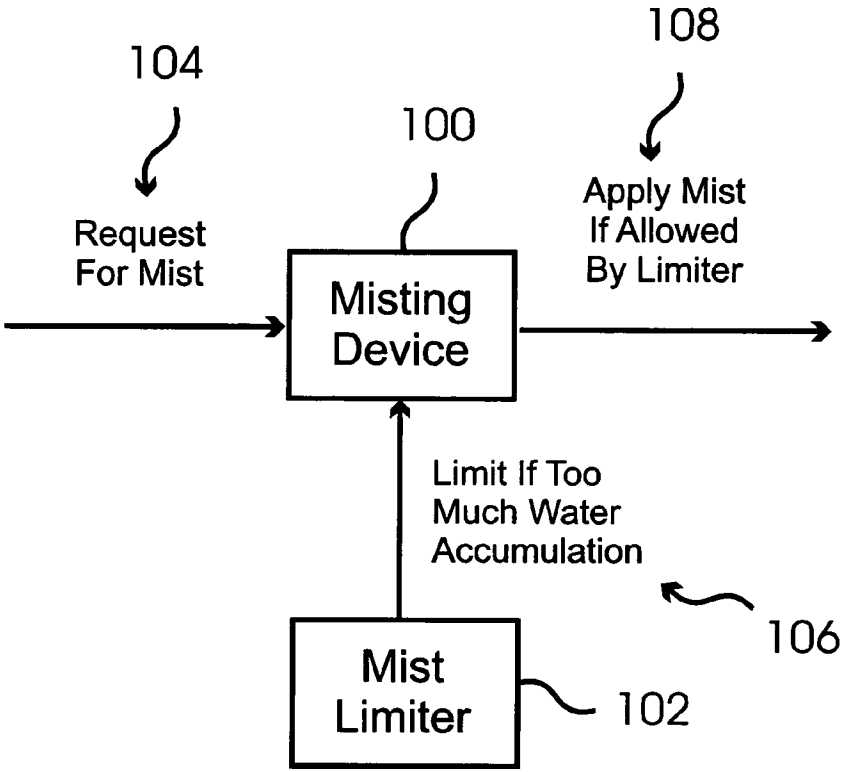
FIG. 1A is a block diagram of a general embodiment of the invention.

With reference to FIG. 1A, the basic apparatus of the invention includes a water droplet application device 100, and a water droplet accumulation limiter 102. A request for misting 104 reaches the apparatus, either due to direct adjustment of a manual control by an individual or due to an automatically generated signal according to the passage of time and/or according to one or more measured physiological parameters. If the water droplet accumulation limiter senses that too much water is accumulating 106 then it will not allow the application of mist. Otherwise, mist is applied 108 to the individual according to the request for misting 104.

Figure 1B:
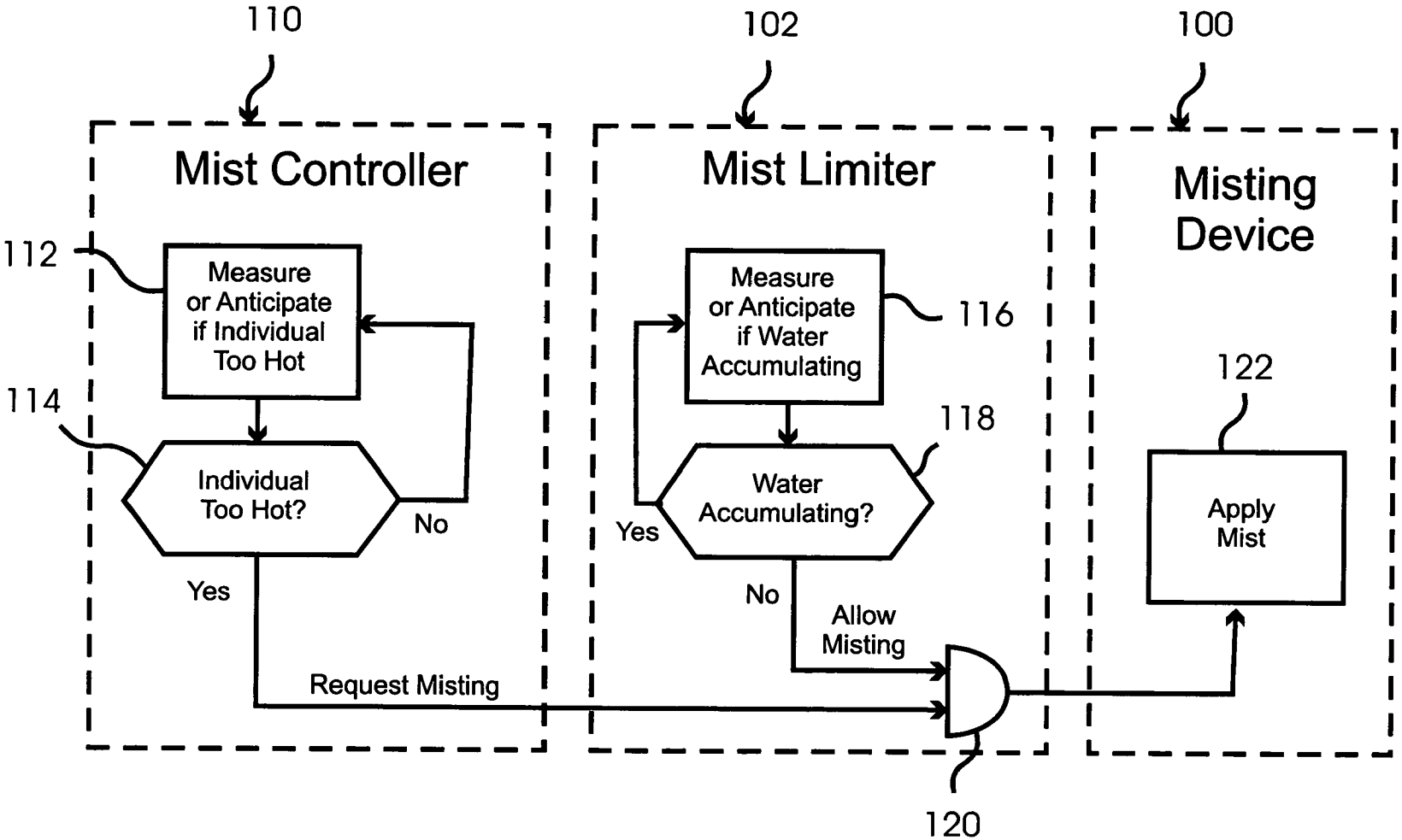
FIG. 1B is a functional diagram of a preferred embodiment including a mist controller that automatically determines the need for misting.

With reference to FIG. 1B, in a more sophisticated embodiment, the apparatus includes a mist controller 110 that sends a request for mist to the water droplet application device 100 when it either measures or estimates 112 that the individual is too hot 114. However, the water droplet accumulation limiter 102 intercepts the signal from the mist controller 110. It measures or anticipates if there is too much water accumulating 116, and if there is too much water accumulating 118 it blocks the signal from the mist controller 110 using a device that functions logically as a signal gate 120. If the water droplet accumulation limiter 102 determines that too much water is not accumulating 118, then the signal from the mist controller 110 is allowed to pass through the gate 120 and reach the water droplet application device 100, which responds by applying mist 122 to the individual.

Figure 1C:
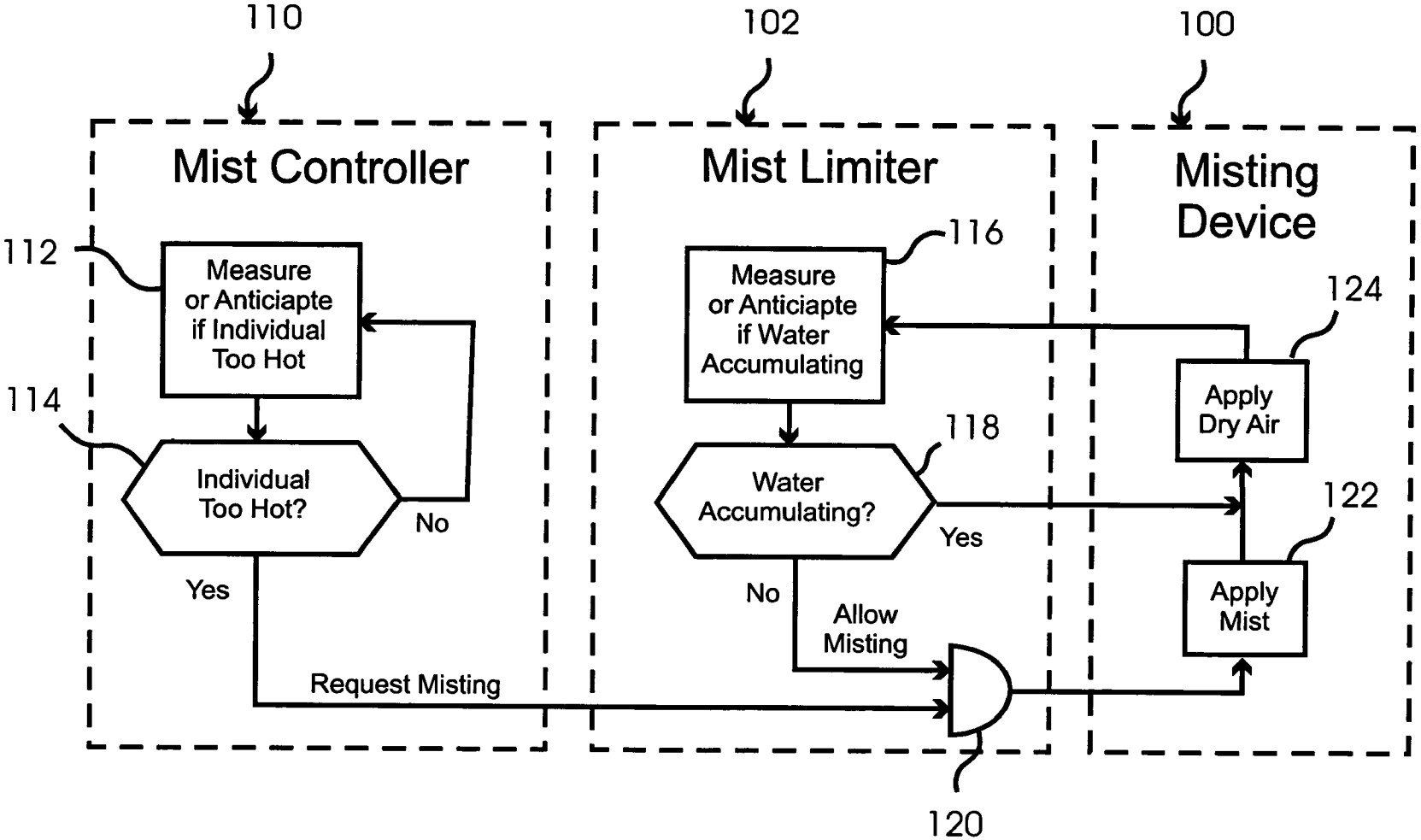
FIG. 1C is a functional diagram of a preferred embodiment similar to FIG. 1B, in which the apparatus is able to apply dry air as well as mist.

FIG. 1C is a logic diagram of a preferred embodiment similar to FIG. 1B, except that the water droplet application device 100 is able to apply dry air 124 to the individual, in addition to water droplets. If the water droplet accumulation limiter 102 determines that too much water is accumulating 118, then a signal is sent to apply dry air 124. If the water droplet accumulation device determines that too much water is not accumulating, 118, then the signal from the mist controller 110 is allowed to pass through the gate 120 and the water droplet application device 100 applies mist 122 followed by dry air 123.

Figure 2A:
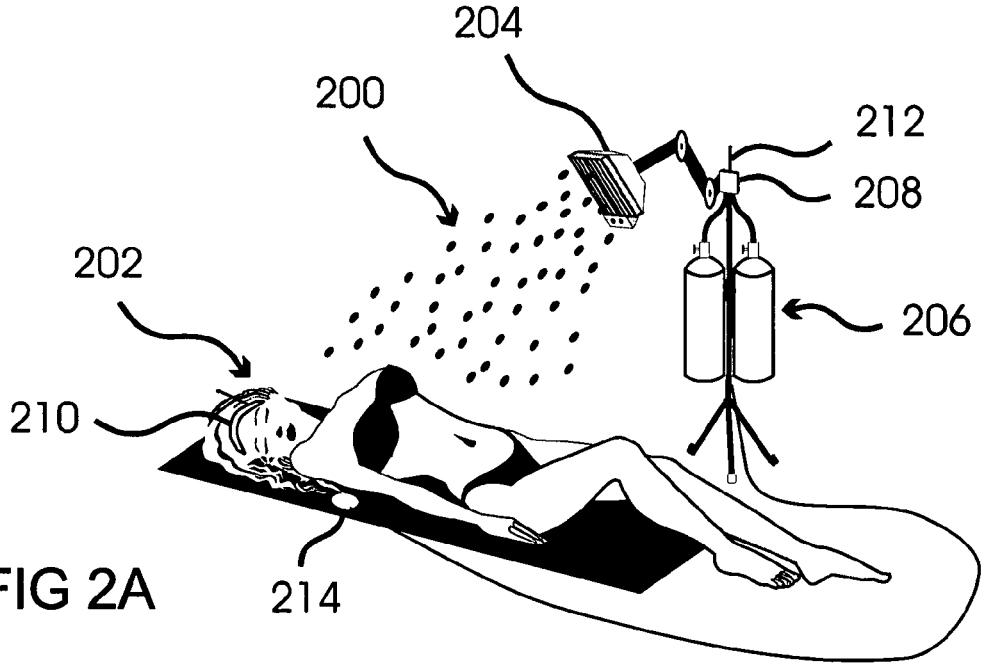
FIG. 2A is a perspective drawing of a reclining individual being cooled by a free standing embodiment of the invention that detects water accumulation using a sensor placed near the individual and monitors the need for cooling using a skin temperature sensor attached to the forehead of the individual.

FIG. 2A is a perspective view of a preferred embodiment wherein cooling mist 200 is applied to an individual 202 lying down in a restful position. The water droplet application device 204 is supported by a free-standing base that includes a supply of water 206 and a mist controller 208 that regulates the intensity of the mist according to the skin temperature of the individual 202 as measured by a sensor 210, such as a thermocouple, attached to the forehead of the individual 202. The sensor 210 communicates with the mist controller 208 by transmitting wireless signals to an antenna 212 attached to the controller 208. The water droplet accumulation limiter, which is located together with the mist controller 208, uses a wetness sensor 214 placed near the individual 202 to detect if water is accumulating.

In order to avoid false readings, whenever possible skin temperatures and core body temperatures are measured at locations that are not directly cooled by mist and dry air. For example, the head band in FIG. 2A is placed at a location where the sensor is not directly cooled by the mist. In addition, the headband is made from a water repellent material containing thermal insulation so as to further isolate the sensor from the mist, and so as to prevent any evaporative cooling of the skin region where the sensor is attached, including evaporative cooling by perspiration. In other embodiments, a tympanic membrane temperature sensor can be used, since the tympanic membrane will not be significantly cooled by the mist. In still other embodiments, the skin temperature of the individual 202 is measured by a sensor, such as an infrared sensor, that is directed toward but not directly attached to the individual 202.

The wetness sensor can consist, for example, of two sets of conducting strips that do not make electrical contact but are placed in very close proximity to each other on an exposed surface of a printed circuit. Accumulating water droplets on the surface of the printed circuit will conductively bridge the two sets of conducting strips, thereby creating electrical conductivity between the two that can be measured and directly related to the degree of wetness on the surface. Another method of sensing wetness is to place a section of water absorbing material between two small metal plates, forming an electrical capacitor. As the water absorption of the material varies, the dielectric constant of the material changes, and the resulting change in capacitance can be related directly to the degree of wetness. For example, the capacitor can be formed as a clip that attaches to the clothing of an individual and directly measures the wetness of the clothing. Other methods include measuring the optical properties of transparent or reflective surfaces, using for example a fiber optic source and detector or a LASER source and detector directed toward but not attached to the transparent or reflective surface.

Figure 2B:
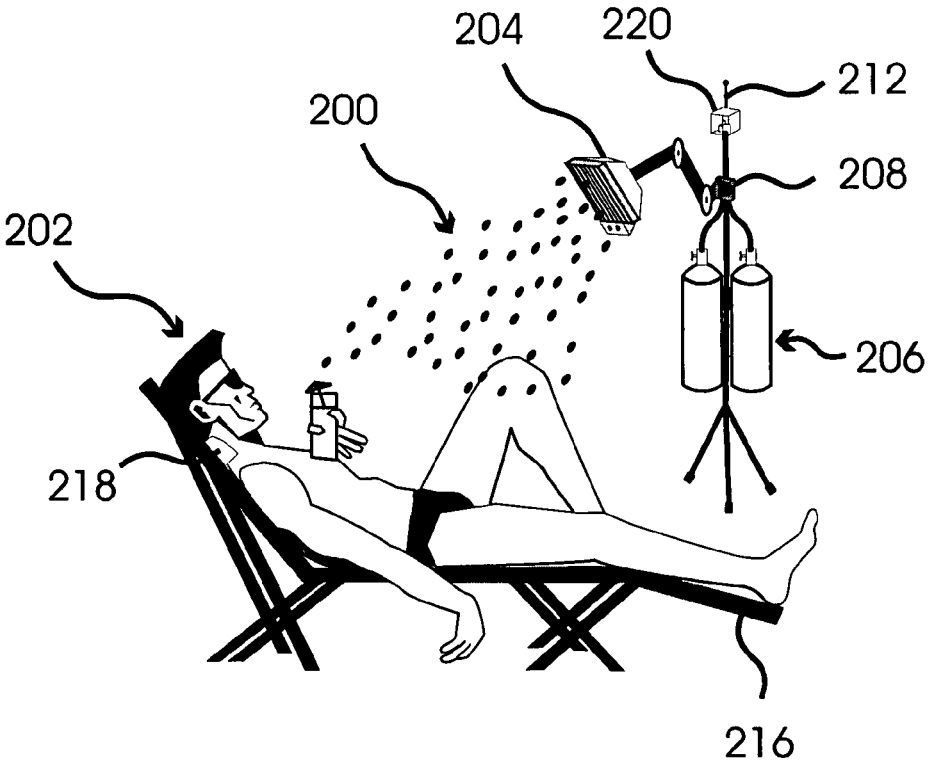
FIG. 2B is a perspective drawing of an individual sitting on a lounge chair being cooled by a free standing embodiment of the invention that estimates the water evaporation rate based on measured climate conditions and monitors the need for cooling using a core body temperature sensor attached to the lounge chair and held in contact with the neck of the individual.

FIG. 2B is a perspective view of a preferred embodiment that is similar to the embodiment of FIG. 2A, except that the individual 202 is resting on a reclining chair 216 and the mist controller 208 operates according to the core body temperature of the individual 202 as measured by a sensor 218 embedded in the back of the chair such that it rests against the neck of the individual 202. In addition, instead of directly measuring water accumulation using a water sensor (214 in FIG. 2A), this embodiment estimates the rate of water evaporation using climate conditions, such as the air temperature, humidity, and wind speed, as measured by a climate sensor 220.

Figure 2C:
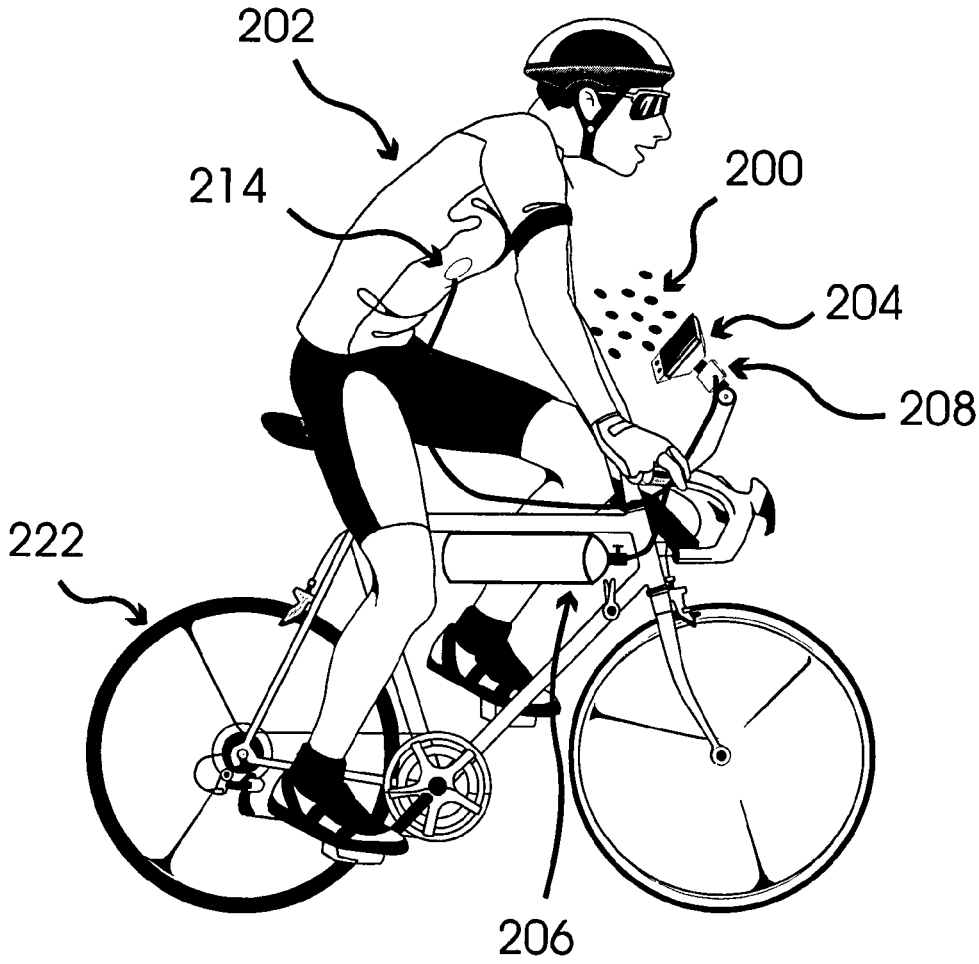
FIG. 2C is a perspective drawing of an individual riding a bicycle while being cooled by a preferred embodiment of the invention that is attached to the bicycle and uses a sensor attached to the clothing of the individual to detect water accumulation.

FIG. 2C is a perspective view of an embodiment functionally identical to the embodiment of FIG. 2A, except that the apparatus is attached to a bicycle 222 being ridden by the individual 202 and the water accumulation sensor 214 is attached to the clothing of the individual.

Figure 3A:
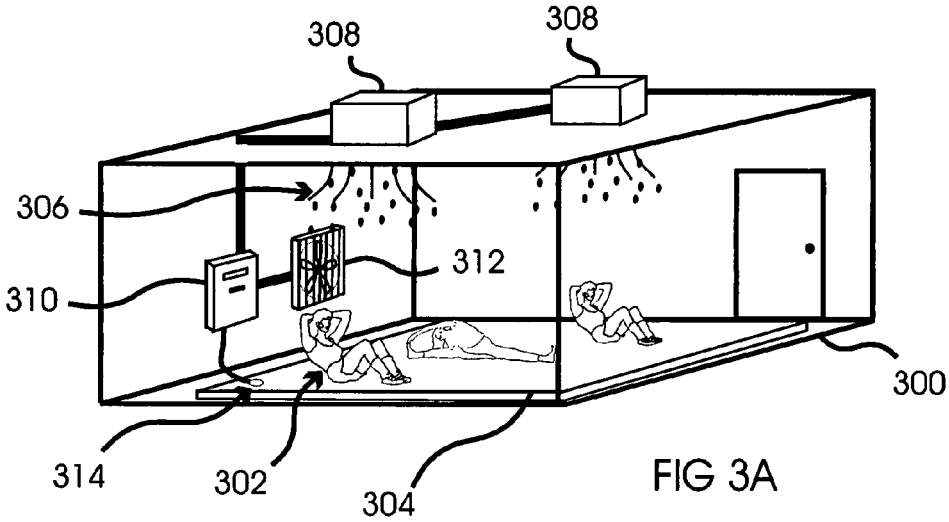
FIG. 3A is a perspective drawing of an embodiment wherein a plurality of individuals exercising in a room is cooled by mist from the ceiling and dry air from a fan on the wall while a sensor on the floor detects any water accumulation.

FIG. 3A is a perspective view of an exercise room 300 in which a group of individuals 302 is exercising on a mat 304 while being cooled by mist 306 emitted by water droplet application devices 308 mounted in the ceiling of the room 300. A mist controller and a water droplet accumulation limiter are contained together in a control unit 310 that also controls a source of dry air 312. A water sensor 314 placed on the mat 304 is used by the water droplet accumulation limiter to detect and prevent accumulation of water.

Figure 3B:
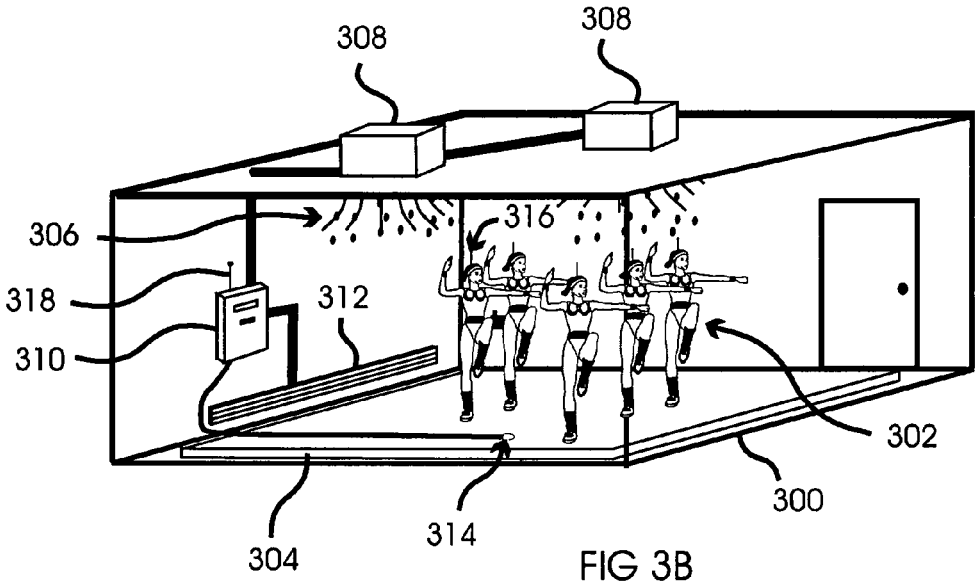
FIG. 3B is a perspective drawing of an embodiment wherein a plurality of individuals exercising in a room is cooled by mist from the ceiling, while the need for cooling is monitored by skin temperature sensors attached to the foreheads of the individuals, a sensor on the floor detects any water accumulation, and a flow of dry air near the floor reduces the tendency for water to accumulate.

FIG. 3B is a perspective view of an embodiment similar to the embodiment of FIG. 3A, except that the mist controller in the control unit 310 operates according to skin temperature measurements from sensors 316 attached to the foreheads of the individuals 302 and transmitted wirelessly to an antenna 318 on the control unit. Also, in this embodiment the source of dry air 312 directs a flow of dry air onto the mat 304, so as to prevent the mat 304 from becoming slippery due to water accumulation.

Figure 4A:
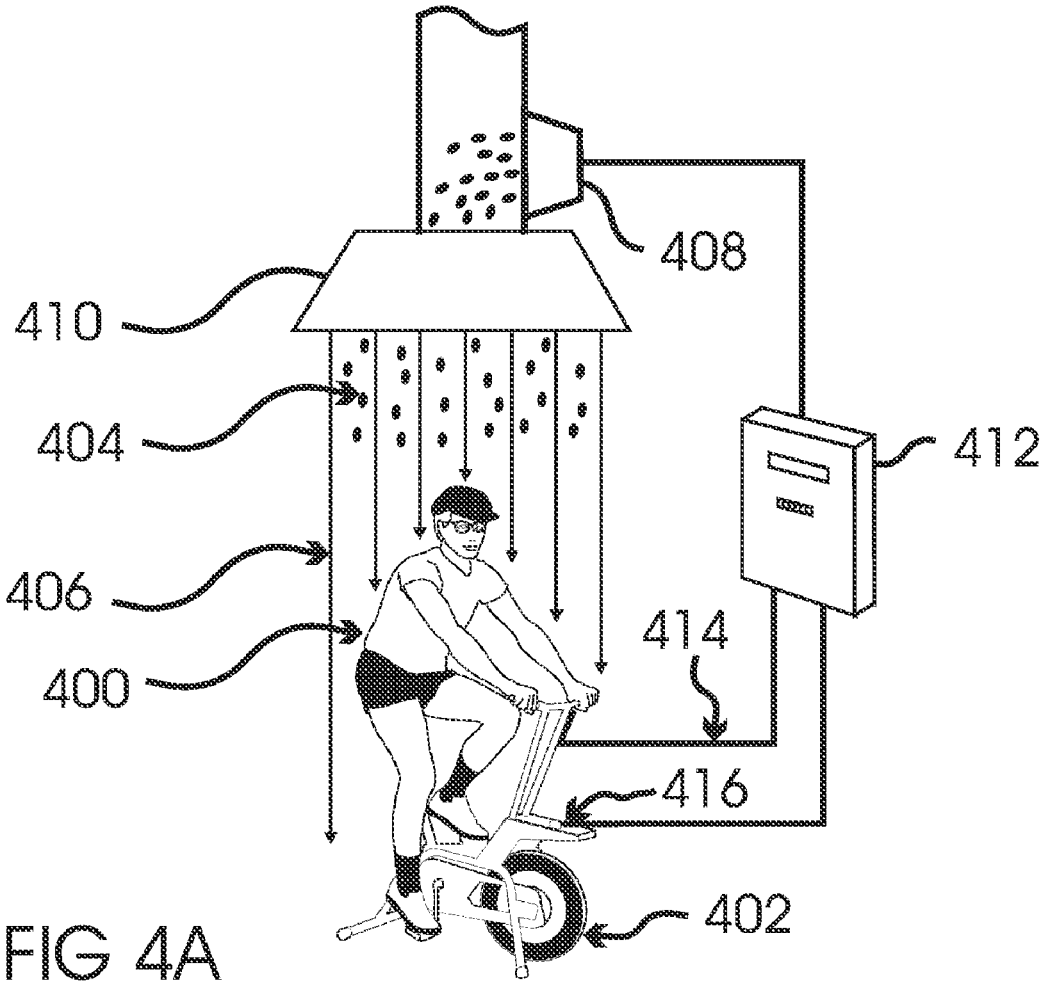
FIG. 4A is a perspective drawing of an individual on a stationary exercise device being cooled by a combined flow of mist and dry air from above.

FIG. 4A is a perspective view of an individual 400 exercising on an exercise device 402 while being cooled by a combined flow of water droplets 404 and dry air 406. A water droplet emission device 408 injects water droplets into a stream of dry air from a dry air source 410. A control unit 412 contains a mist and dry air controller that operates according to the pulse rate of the individual 400 as measured by a sensor embedded in a handle of the exercise device 402 and transmitted to the control unit 412 by a wire 414. A water droplet accumulation limiter, also located inside of the control unit 412, uses a water sensor 416 attached to the exercise device 402 to detect water accumulation.

Figure 4B:
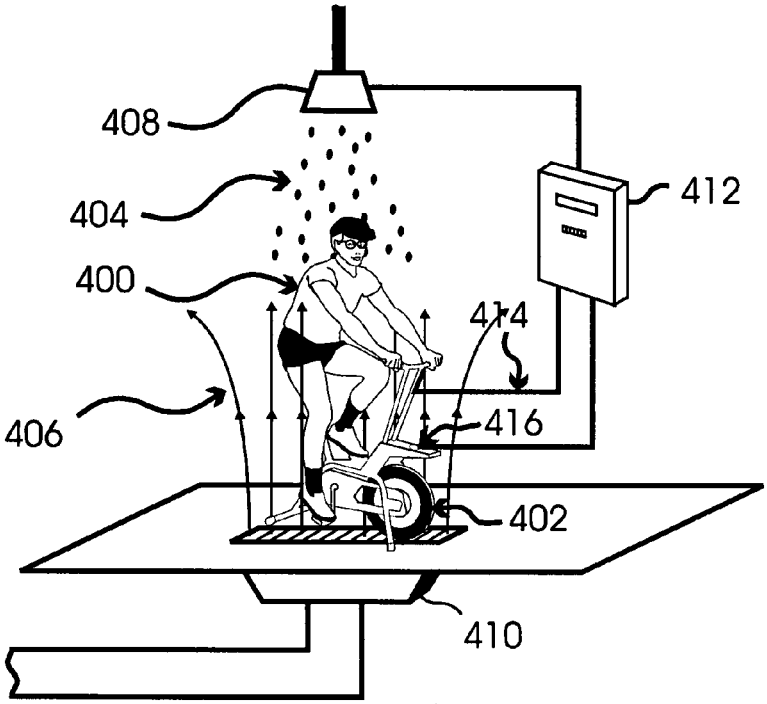
FIG. 4B is a perspective drawing of an individual on a stationary exercise device being cooled by a flow of water droplets from above and a flow of dry air from below.
Figure 4C:
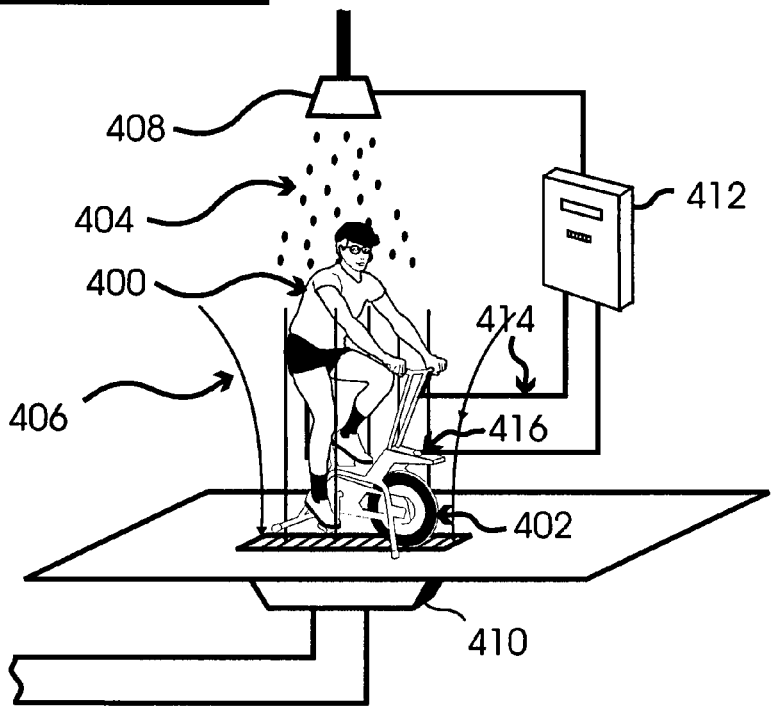
FIG. 4C is a perspective drawing of an individual on a stationary exercise device being cooled by a flow of water droplets from above and a flow of dry air from the room into an air intake vent located below the exercise device.

FIG. 4B and FIG. 4C are perspective views of preferred embodiments similar to the embodiment of FIG. 4A, except that the water droplets 404 are not injected into the flow of dry air 406. Instead, in FIG. 4B the droplets 404 are applied from above the individual 400 while the flow of dry air 406 is applied from below, while in FIG. 4C the droplets 404 are applied from above the individual 400 while air 406 flows past the individual and into a vent 410 in the floor below the individual.

In general, the evaporative cooling efficiency of mist can be enhanced by surrounding an individual with dry air, either drawn from outside if the outside air is naturally dry, or through use of a dehumidifier.

Figure 4D:
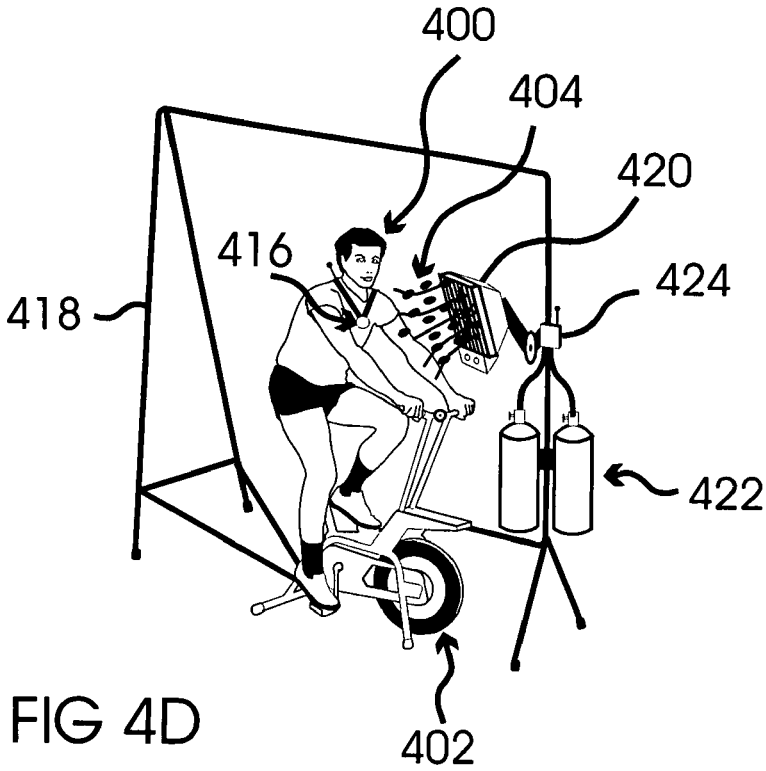
FIG. 4D is a perspective drawing of an individual on a stationary exercise device being cooled by a flow of water droplets from the front emitted by a water droplet emission device attached to the exercise device.

FIG. 4D is a perspective view of a preferred embodiment in which a frame 418 is used to attach the apparatus of the invention to an exercise device 402. In this embodiment, the water droplets 404 are carried by a flow of air from a manually controlled water droplet emitting device 420 attached to containers 422 of water. The flow of air is generated by a fan contained in the water droplet emitting device 420 and powered either by a battery or by an external power source via a power cord (not shown). A water droplet accumulation limiter 424 operates according to measurements transmitted wirelessly from a water sensor 416 worn by the individual 400.

Figure 4E:
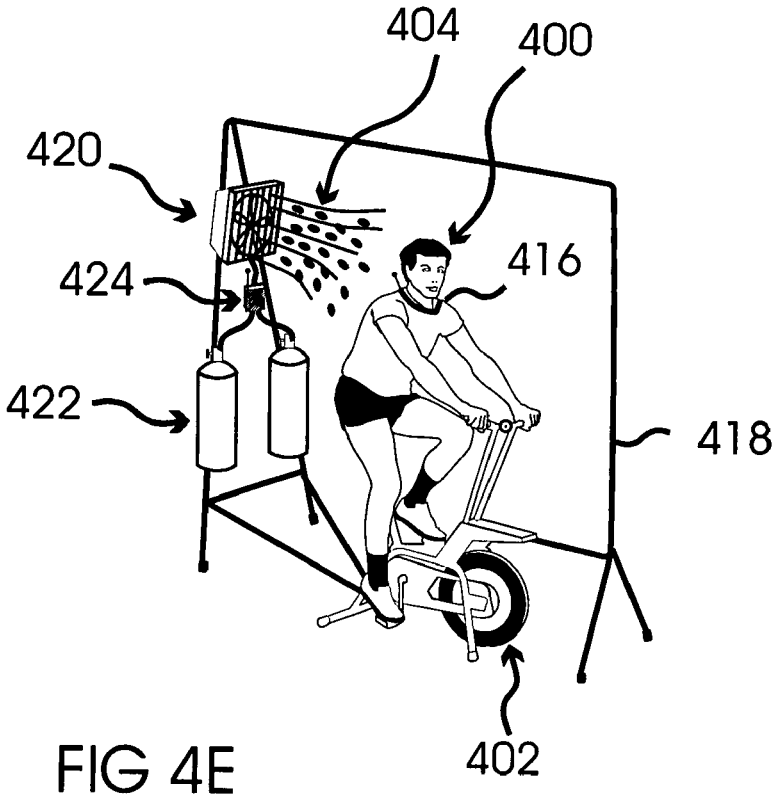
FIG. 4E is a perspective drawing of an individual on a stationary exercise device being cooled by a flow of water droplets from behind emitted by a water droplet emission device attached to the exercise device.

FIG. 4E is a perspective view of an embodiment very similar to the embodiment of FIG. 4D, except that the water droplet emitting device 420 is mounted such that the mist 404 is applied from behind the individual 400.

Figure 5:
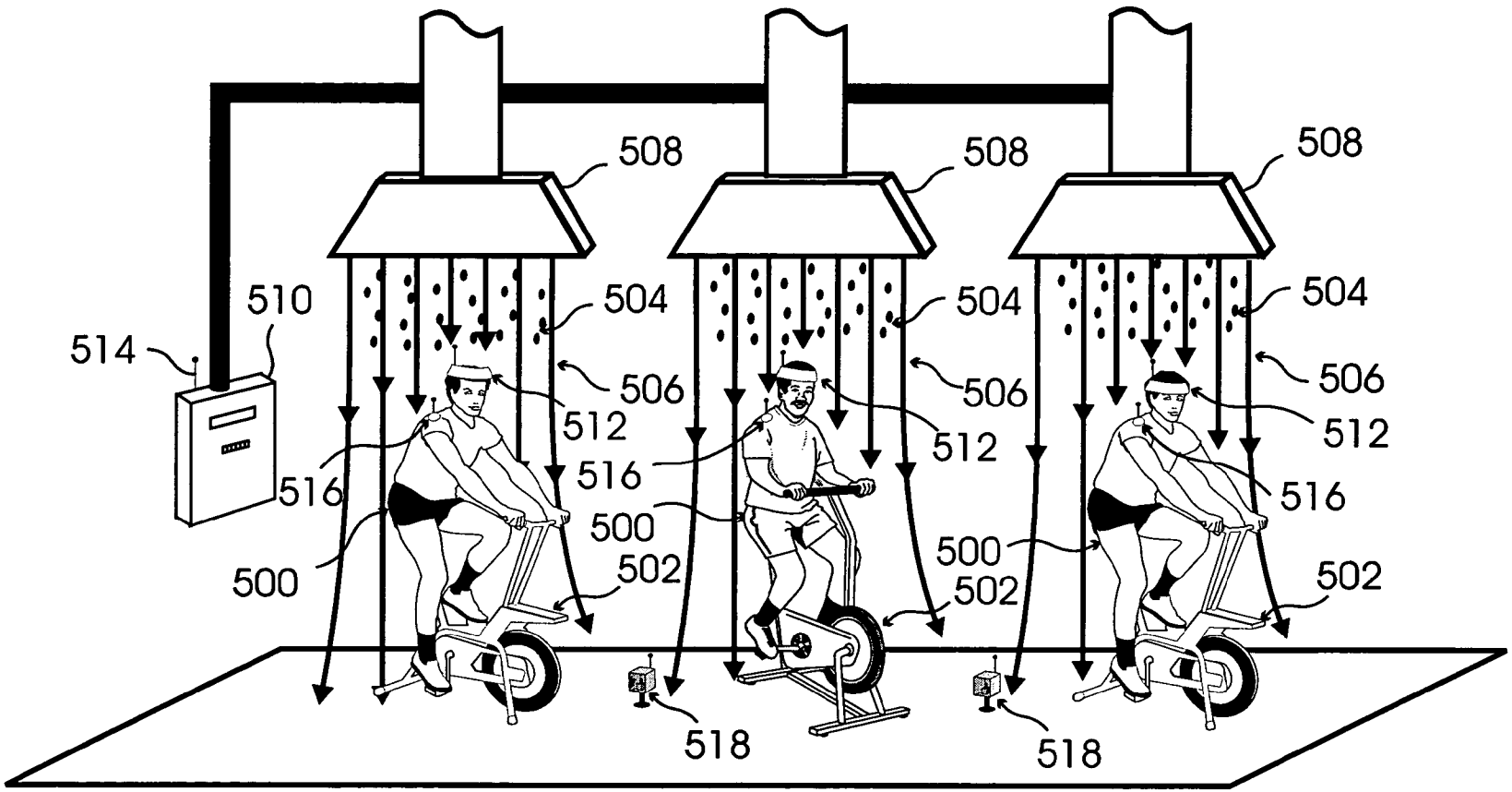
FIG. 5 is a perspective drawing of a plurality of individuals on exercise devices, each being cooled from above by a separate source of water droplets combined with dry air.

FIG. 5 is a perspective view of a preferred embodiment in which a plurality of individuals 500 using a plurality of exercise devices 502 are cooled by a combined flow of mist 504 and dry air 506 emitted by water droplet application devices 508 positioned above the exercise devices 502. The water droplet application devices 508 are controlled by a single control unit 510 that contains a mist controller (110 in FIG.

1B) and a water droplet accumulation limiter (102 in FIG. 1B). The mist controller (110 in FIG. 1B) operates according to skin temperature measurements transmitted wirelessly from sensors 512 attached to the individuals 500 and received by an antenna 514 attached to the control unit 510. The water droplet accumulation limiter (102 in FIG. 1B) operates according to water measurements transmitted wirelessly to the antenna 514 on the control unit 510 from water sensors 516 attached to the clothing of the individuals 500.

In preferred embodiments, the mist controller (110 in FIG. 1B) and/or the water droplet accumulation limiter (102 in FIG. 1B) can operate according to average measurements obtained from the plurality of individuals, or they can separately control the misting and the application of dry air to each of the individuals. In addition, airborne water droplet sensors 518 measure the density of water droplets in the air near the ground, and transmit this information wirelessly to the antenna 514 on the controller 510. This information is used to limit the application of water droplets and prevent an excess density of water droplets in the air near the floor.

FIG. 6A through FIG. 6C are logic diagrams that depict strategies by which water droplet accumulation limiters that use sensors to sense water accumulation operate in preferred embodiments. In the embodiment of FIG. 6A mist is applied 600, after which a comparison is made 602 between a user specified maximum water accumulation 604 and the sensor measurement 606 of water accumulation. If it is determined 608 that too much water has accumulated, then the misting stops and the system waits 610 until the excess water has evaporated. The embodiment of FIG. 6B is similar, except that the system does something, such as applying dry air, to encourage water evaporation 612 if it is determined 608 that too much water has accumulated. In the embodiment of FIG. 6C, also similar to the embodiments of FIG. 6A and FIG. 6B, if it is determined 608 that too much water has accumulated the system reduces the intensity and/or duration of bursts of misting 614 rather than halting the misting altogether.

FIG. 6D through FIG. 6F are logic diagrams that depict strategies by which water droplet accumulation limiters operate in preferred embodiments by measuring climate conditions and estimating the rate of water evaporation. In the embodiment of FIG. 6D mist is applied 600, after which the air temperature and humidity are measured 616 and the water evaporation rate is estimated 618. A correction to the estimated evaporation rate is applied 620 according to a user specified correction factor 622 that serves to compensate for errors due to factors such as wind velocity, intensity of sunshine, physical separation between the atmospheric sensor and the user, and other factors that the system is not able to measure or take into account. According to the corrected estimate, if the misting rate is determined to be greater than the evaporation rate 622, the amount of accumulated water is calculated and the misting is halted 624 temporarily to allow the accumulated water to evaporate.

The embodiment of FIG. 6B is similar, except that the system does something, such as applying dry air, to encourage water evaporation 612 if the misting rate is determined to be greater than the evaporation rate 622. In the embodiment of FIG. 6F, similar to the embodiments of FIG. 6C and FIG. 6D, if the misting rate is determined to be greater than the evaporation rate 622 the system reduces the intensity and/or duration of bursts of misting 614 until the misting rate is equal to or less than the evaporation rate.

FIG. 6G and FIG. 6H are logic diagrams that depict strategies used in preferred embodiments wherein water droplet accumulation limiters use sensors to sense water accumulation, and wherein the controller apparatus includes means to apply dry air to the individual. FIG. 6G is similar to FIG. 6B, and FIG. 6H is similar to FIG. 6C, except that in both cases dry air is applied 626 after each application of mist 604.

FIG. 7A is a graphical presentation of mist control strategies for exercising 700 and resting 702 individuals in preferred embodiments where the mist is applied intermittently 704, 706. In each case, the on/off ratio 708 of the intermittent misting is adjusted according to the measured skin temperature 710 of the individual, with the on/off ratio 708 being increased linearly as the skin temperature 710 rises.

FIG. 7B is a graphical presentation of a mist control strategy 712 for an exercising individual in a preferred embodiment wherein the mist is applied intermittently 704, 706. In this embodiment the misting on/off ratio 708 is increased linearly as the measured core body temperature 714 rises above a baseline temperature.

FIG. 7C is a graphical presentation of a mist control strategy 716 for a resting individual in a preferred embodiment wherein the density of water droplets 718, 720 is varied until a point is reached 722 where no further changes of the density 724 are needed to maintain a desired skin temperature 726.

FIG. 7D is a graphical presentation of a mist control strategy 728 for an exercising individual wherein the density 718, 720, 730 of the water droplets is increased linearly as the measured pulse rate 732 of the individual rises.

FIG. 7E is similar to FIG. 7D, except that the density of the water droplets 730 is linearly increased 734 as the measured heart rate approaches the age related maximum heart rate 736 for the individual.

FIG. 8 is a front drawing of a control panel for a preferred embodiment wherein the user manually adjusts the desired level of misting intensity 800 and the maximum wetness level (in arbitrary units) 802. In different embodiments the misting intensity 800 represents the on/off ration of an intermittent flow, a water droplet density of a continuous flow, an average rate of droplet application, or any other factor or combination of factors that determine the overall rate at which droplets are applied to the individual. In this embodiment, the user selects from between four levels of intensity, labeled "High," "Medium," "Low," and "Off." The maximum wetness level 802 is entered using pushbuttons to increase 804 and decrease 806 the value.

FIG. 9 is a front drawing of a control panel for a preferred embodiment wherein the apparatus is automatically controlled according to the measured skin temperature and wetness of an individual as compared to user specified maximums, and wherein the apparatus controls the flow and humidity of the air near the individual in addition to the application of mist. A maximum skin temperature 900 is entered using pushbuttons 902, 904, and is compared to a measured skin temperature 906. Also, a maximum wetness level 908 (in arbitrary units) is entered using pushbuttons 910, 912, and is compared to an actual wetness level 914 determined by a sensor placed on or near the individual. If the actual skin temperature 906 rises above the user specified maximum skin temperature 900, then the mist controller requests the application of mist. If the actual wetness level 914 is below the maximum specified wetness level 908, then the mist limiter allows the misting device to apply mist, which is indicated by a light 916 on the control panel. A fan is used to apply an air flow to the individual, either during or in between mist applications, which is also indicated by a light 918 on the front panel. Depending on the dryness of the ambient air, a built-in dehumidifier is also used to dry the air before it is applied to the individual. Once again, this is indicated by a light 920 on the front panel.

If the actual wetness level 914 exceeds the user specified maximum wetness level 908, then any requests for mist application are blocked by the mist limiter, and a light on the front panel 922 indicates this blockage, while the fan 918 and air dryer 920 indicating lights continue to indicate that dry air is being used to remove the excess water from the individual. A power indicating light 924 is also provided to indicate that the unit is switched on.

FIG. 10 A through FIG. 10C illustrate different methods of sensing wetness. With reference to FIG. 10A, a section of printed circuit board 1000 has two interdigitating combs of conducting material 1002, 1004 etched onto an exposed surface, such that the "fingers" of the two interdigitating combs 1002, 1004 lie close to each other but do not touch. Droplets of water 1006 landing on the surface inevitably bridge the gaps between the combs, causing conductivity and/or a change in capacitance between the two combs that can be measured with a conductivity measuring device or a capacitance measuring device.

With reference to FIG. 10B, another method for sensing wetness is by reflectivity. A section of reflective material 1008 such as a mirror is placed where wetness is to be measured. A light source 1010, such as a LASER, directs a beam of light 1012 onto the reflective material 1008, and the intensity of the reflected beam 1014 is measured by a light detector 1016. As water droplets 1006 collect on the reflective surface 1006, some of the incident light 1012 is scattered 1018, thereby reducing the intensity of light measured by the light detector 1016. In a similar approach (not shown), a beam of light is caused to pass through a transparent section of material, such as a piece of glass, and a light detector measures the intensity of transmitted light. Water droplets that collect on the transparent section scatter some of the light, and reduce the intensity measured by the light detector.

A more sophisticated method of measuring wetness is illustrated in FIG. 10C. A section of opaque material 1020 is placed where wetness is to be measured, and is illuminated by light 1022 from a conventional lamp 1024 or other light source. A camera 1026 is directed toward the section 1020 so that it receives light from the section 1028 and records the appearance of the section 1020. Machine vision software (not shown) is then used to analyze the image and determine the degree of accumulated wetness.

Other modifications and implementations will occur to those skilled in the art without departing from the spirit and the scope of the invention as claimed. Accordingly, the above description is not intended to limit the invention except as indicated in the following claims.

What is claimed is:

1. An apparatus for cooling at least one individual, comprising:

at least one water droplet emission device capable of emitting water droplets; and at least one water droplet accumulation limiter, capable of automatically modifying the action of the at least one water droplet emission device, in response to a measurement or an estimation of water accumulation on a surface associated with the at least one individual, so as to limit the accumulation of water droplets on the surface associated with the at least one individual.

2. The apparatus of claim 1, wherein the water droplets applied by the at least one the water droplet emission device are at least one of:

a mist of water; a spray of water; and a shower of water.

3. The apparatus of claim 1, wherein at least one of the water droplet emission devices is attached to an object used by one of the individuals.

4. The apparatus of claim 3, wherein the object used by one of the individuals is one of an exercise device and a resting device.

5. The apparatus of claim 1, wherein the water droplet emission device is able to control at least one of:

duration of emitting of water droplets;
frequency of emitting of water droplets;
rate of emission of water droplets;
numerical density of emitted water droplets;
size of emitted water droplets;
temperature of emitted water droplets;
initial direction of travel of emitted water droplets;
initial speed of travel of emitted water droplets; and
divergence of emitted water droplets.

6. The apparatus of claim 1, wherein the water droplet emission device is automatically controlled at least according to a measured physiological parameter.

7. The apparatus of claim 6, wherein the water droplet emission device is automatically controlled at least according to at least one of:

the skin temperature of at least one of the individuals;
the heart rate of at least one of the individuals;
the core body temperature of at least one of the individuals; and
the perspiration of at least one of the individuals.

8. The apparatus of claim 6, wherein a physiological parameter is measured by a sensor that is one of attached to and directed toward one of the individuals.

9. The apparatus of claim 6, wherein a physiological parameter is measured by a sensor embedded in an object used by one of the individuals.

10. The apparatus of claim 1, wherein the water droplet emission device is controlled at least according to the activity of an exercise machine used by the at least one individual.

11. The apparatus of claim 10, wherein the water droplet emission device is controlled at least according to one of the rate of energy expended on the exercise machine and the cumulative amount of energy expended on the exercise machine.

12. The apparatus of claim 1, wherein the water droplets are carried by a stream of air.

13. The apparatus of claim 12 wherein the water droplet emission device controller is able to control at least one of the speed and the direction of the stream of air that carries the water droplets.

14. The apparatus of claim 1, wherein the surface associated with the at least one individual includes at least one of a part of an individual's body, a part of an individual's clothing, and other surfaces near the at least one individual.

15. The apparatus of claim 1, wherein the water droplet accumulation limiter includes at least one device for detecting the accumulation of water droplets on the surface associated with the individual.

16. The apparatus of claim 15, wherein the device for detecting the accumulation of water droplets operates according to a detected change in at least one of:

resistance; capacitance; optical reflectivity; optical transmission; and visual appearance.

17. The apparatus of claim 1 wherein the water droplet accumulation limiter is able to compute the rate at which water evaporates from the surface associated with the individual.

18. The apparatus of claim 17, wherein the water droplet accumulation limiter is able to detect at least one of the humidity of the air, the air temperature, the direction of air flow, and the speed of air flow at the surface associated with the individual.

19. The apparatus of claim 1, further comprising an airborne droplet detection device that is able to detect and limit the presence of airborne droplets in a volume of space.

20. The apparatus of claim 1, further comprising a humidity control device that is able to control the humidity of the air near the at least one individual.

21. The apparatus of claim 20, wherein the humidity control device produces a flow of humidity controlled air directed upon the at least one individual.

22. The apparatus of claim 21, wherein the apparatus is able to alternate between applying water droplets and applying humidity controlled air to the at least one individual.

23. The apparatus of claim 21, wherein at least one water droplet emission device is able to inject water droplets into the flow of humidity controlled air so that the droplets are directed upon the at least one individual together with the humidity controlled air.

24. The apparatus of claim 23, wherein the apparatus is able to alternate between injecting water droplets into the stream of humidity controlled air and not injecting droplets into the stream of humidity controlled air.

25. A method for cooling at least one individual, comprising:

incorporating a water droplet emission device and a water droplet accumulation limiter as part of an apparatus;

applying water droplets to the at least one individual by operating the water droplet emission device; and automatically limiting the application of water droplets by operating the water droplet accumulation limiter so as to prevent further accumulation of water droplets on a surface associated with the at least one individual, in response to a measurement or an estimation of water accumulation on a surface associated with the at least one individual.

26. The method of claim 25, wherein automatically limiting the application of water droplets includes sensing the presence of water droplets on the surface and limiting the application of droplets when an excess of water droplets is detected.

27. The method of claim 25, wherein automatically limiting the application of water droplets includes computing the rate at which water droplets evaporate from the surface and limiting the application of water droplets such that the rate at which water droplets are applied to the surface is less than the rate at which water droplets evaporate from the surface.

28. The method of claim 27, including controlling and adjusting the humidity of the air surrounding the at least one individual so as to enhance the cooling capacity and the cooling efficiency of the water droplets, reduce the tendency of water droplets to accumulate, and increase the comfort of the at least one individual.

29. The method of claim 26, including controlling and adjusting the humidity of the air surrounding the at least one individual so as to enhance the cooling capacity and the cooling efficiency of the water droplets, reduce the tendency of water droplets to accumulate, and increase the comfort of the at least one individual.

30. The method of claim 25, including controlling and adjusting the humidity of the air surrounding the at least one individual so as to enhance the cooling capacity and the cooling efficiency of the water droplets, reduce the tendency of water droplets to accumulate, and increase the comfort of the at least one individual.

* * * * *